US012808200B2

(12) United States Patent
Yasuda et al.

(10) Patent No.: US 12,808,200 B2
(45) Date of Patent: Nov. 24, 2026

(54) ATTACHMENT STRUCTURE FOR POLYGONAL PANEL

(71) Applicant: YASUDA CO., LTD., Osaka (JP)

(72) Inventors: Makoto Yasuda, Osaka (JP); Yoshimasa Harada, Osaka (JP); Kazuo Matsuo, Kyoto (JP)

(73) Assignee: YASUDA CO., LTD., Osaka (JP)

( * ) Notice: Subject to any disclaimer, the term of this patent is extended or adjusted under 35 U.S.C. 154(b) by 384 days.

(21) Appl. No.: 18/579,078

(22) PCT Filed: Jul. 27, 2021

(86) PCT No.: PCT/JP2021/027713
§ 371 (c)(1),
(2) Date: Aug. 1, 2024

(87) PCT Pub. No.: WO2023/007580
PCT Pub. Date: Feb. 2, 2023

(65) Prior Publication Data

US 2024/0376720 A1 Nov. 14, 2024

(51) Int. Cl.
*E04F 13/08* (2006.01)

(52) U.S. Cl.
CPC ..... *E04F 13/083* (2013.01); *E04F 13/0891* (2013.01)

(58) Field of Classification Search
CPC . E04F 13/08; E04F 13/21; E04F 13/22; E04F 13/23; E04F 13/24; E04F 13/25; E04F 13/26
See application file for complete search history.

(56) References Cited

U.S. PATENT DOCUMENTS 10,208,484 B1 * 2/2019 Simonsen ..... E04F 13/08
10,697,183 B1 * 6/2020 Ferguson ..... E04F 13/24
(Continued)

FOREIGN PATENT DOCUMENTS

CH 659679 A5 2/1987
CN 1167865 A 12/1997
(Continued)

OTHER PUBLICATIONS

International Search Report issued in PCT/JP2021/027713 mailed Sep. 14, 2021.
Office Action issued in CN202180100983.4, dated Mar. 26, 2026.

*Primary Examiner* — Joshua J Michener
*Assistant Examiner* — Henry Hooper Mudd
(74) *Attorney, Agent, or Firm* — Nicholas Mesiti, Esq.; Heslin Rothenberg Farley & Mesiti P.C.

(57) ABSTRACT

A polygonal panel mounting structure facilitates mounting work, enables a single worker to perform the mounting work, and can adapt to the deformation of a mounting surface of a wall, a roof, a ceiling, or the like even when the mounting surface is slightly deformed due to an earthquake, a strong wind, or the like, thus preventing the distortion of the mounted panel. A fitting portion of a fitting frame provided on a one side portion of a polygonal panel is loosely fitted into a fitting groove provided on one of furring strip base frames that are fixed parallel to each other on mounting surface of the polygonal panel, and a fitting cap provided at a corner facing the one side portion of the polygonal panel is fitted into a fitting receiver provided on the other of the furring strip base frames so as to be swingable.

2 Claims, 50 Drawing Sheets

(56) References Cited

U.S. PATENT DOCUMENTS

| | | | | |
|---|---|---|---|---|
| 12,037,796 | B2 * | 7/2024 | Gouws | E04F 13/08 |
| 2008/0010922 | A1 * | 1/2008 | Wagner | E04H 15/52 52/235 |
| 2010/0011688 | A1 * | 1/2010 | Moran | E04B 1/04 52/250 |
| 2019/0100913 | A1 * | 4/2019 | Doyon | E04B 2/96 |
| 2020/0080306 | A1 * | 3/2020 | Richardson | E04B 9/04 |

FOREIGN PATENT DOCUMENTS

| | | | |
|---|---|---|---|
| CN | 1515769 | A | 7/2004 |
| JP | 39907 | | 12/1992 |
| JP | H0598765 | A | 4/1993 |
| JP | H06299676 | A | 10/1994 |
| JP | 7102671 | A | 4/1995 |
| JP | 200492020 | A | 3/2004 |
| JP | 2004108043 | A | 4/2004 |
| JP | 2008144492 | A | 6/2008 |
| JP | 2011157699 | A | 8/2011 |
| KR | 102000262 | B1 | 7/2019 |
| WO | 8603539 | A1 | 6/1986 |

* cited by examiner

ATTACHMENT STRUCTURE FOR POLYGONAL PANEL

CROSS REFERENCE TO RELATED APPLICATIONS

This application is the National Phase filing under 35 U.S.C. § 371 of International Application No.: PCT/JP2021/027713, filed on Jul. 27, 2021. The contents of this prior application is hereby incorporated by reference herein in its entirety.

TECHNICAL FIELD

The present invention relates to a mounting structure for a polygonal panel that is mounted on a wall, a roof, a ceiling, or the like of a building.

BACKGROUND ART

Conventional mounting structures for a wall panel to be mounted on a wall of a building include a mounting structure in which at least one worker lifts the wall panel, and another worker bolts or screws the wall panel in place using metal fittings (Patent Literature 1).

Such a wall panel mounting structure requires at least two workers, and a worker who lifts the wall panel must keep lifting the wall panel while another worker bolts or screws, which is strenuous for the lifting worker. The mounting structure also has a problem in that the wall panel cannot be mounted by a single worker.

Therefore, as a mounting structure that significantly facilitates mounting work for a wall panel and enables a single worker to perform the mounting work, a mounting structure as described below has been devised: a male member attached to a wall panel and a receiving member with a female portion attached to a wall are used, and in a state where the male member has been forcibly fitted into the female portion while deformed under the pushing force of the wall panel in a direction toward the receiving member, the male member is restored in the female portion to prevent its detachment (Patent Literature 2).

Such a wall panel mounting structure is excellent in durability even after many years of use because the male member attached to the wall panel and the receiving member with the female portion attached to the wall are firmly fitted to each other.

CITATION LIST

Patent Literature

Patent Literature 1: Japanese Patent Laid-Open No. 2004-92020

Patent Literature 2: Japanese Patent Laid-Open No. 2008-1444492

SUMMARY OF INVENTION

Technical Problem

However, while being excellent in durability over many years of use, the wall panel mounting structure described in Patent Document 2 has a problem with being unable to adapt the deformation of the wall when the wall is deformed due to an earthquake, a strong wind, or the like, resulting in the distortion of the wall panel mounted.

Therefore, the present invention is to solve the above conventional problems, and an object of the present invention is to provide a polygonal panel mounting structure that significantly facilitates mounting work for a wall panel, enables a single worker to perform the mounting work, and can adapt to the deformation of a mounting surface of a wall, a roof, a ceiling, or the like even when the mounting surface is slightly deformed due to an earthquake, a strong wind, or the like, thus preventing the distortion of the mounted panel.

Solution to Problem

Therefore, in the polygonal panel mounting structure according to the present invention, a fitting portion 11 of a fitting frame 10 provided on a one side portion 1*a* of a polygonal panel 1 is loosely fitted into a fitting groove 21 provided on one of furring strip base frames 20 that are fixed parallel to each other on a mounting surface 2 of the polygonal, panel 1, and a fitting cap 12 provided at a corner 1*b* facing the one side portion 1*a* of the polygonal panel 1 is fitted into a fitting receiver 22 provided on the other of the furring strip base frames 20 so as to be swingable.

In the polygonal panel mounting structure according to the present invention, the fitting cap 12 is provided with opposite surface portions 12*b*, 12*b* projecting parallel to each other in an elastically deformable manner from both side ends of an attachment surface portion 12*a* that is attached to the corner 1*b* of the polygonal panel 1. Further, the fitting receiver 22 includes an insertion portion 22*a* to be inserted into fitting grooves 21, 21*e* of the furring strip base frame 20, and the insertion portion 22*a* is continuously connected to a fitting surface portion 22*c* designed to be fitted between the opposite surface portions 12*b*, 12*b* of the fitting cap 12.

In the polygonal panel mounting structure according to the present invention, the fitting portion 11 of the fitting frame 10 includes a first flat portion 11*a* projecting parallel to the mounting surface 2 of the polygonal panel 1 from an attachment surface portion 10*a* to be attached to the polygonal panel 1, a second flat portion 11*b* projecting at a right angle to the mounting surface 2 from the first flat portion 11*a*, and a third flat portion 11*c* projecting at a right angle from a side end of the second flat portion 11*b*. The fitting portion 11 inwardly includes, at an outer end of the third flat portion 11*c*, a first rib 11*d* projecting parallel to the second flat portion 11*b*. The fitting portion 11 outwardly includes, at the outer end of the third flat portion 11*c*, an inclined rib 11*e* angled at 30 to 60 degrees with respect to the third flat portion 11*c*, and further includes, at a base end of the inclined rib 11*e*, a second rib 11*f* projecting at a right angle to the flat portion 11*b*. Further, the fitting groove 21 of the furring strip base frame 20 is surrounded by a fixed surface portion 20*a* to be fixed to the mounting surface 2, a flat portion 21*a* parallel to the fixed surface portion 20*a*, and an opposite surface portion 20*b* projecting from the fixed surface portion 20*a*. A retaining rib 21*b* engaged with the first rib 11*d* of the fitting portion 11 is provided at the outer end of the flat portion 21*a*. The first rib 11*d* slides on the flat portion 21*a*, and the inclined rib 11*e* of the fitting portion 11 slides on the fixed surface portion 20*a*. The second rib 11*f* of the fitting portion 11 is attachable to and detachable from the opposite surface portion 20*b*.

Advantageous Effects of Invention

The polygonal panel mounting structure according to the present invention significantly facilitates mounting work for a wall panel that is mounted on a wall, a roof, a ceiling, or the like of a building, and enables a single worker to perform the mounting work.

Further, in the polygonal panel mounting structure according to the present invention, the polygonal panel that is mounted on a wall, a roof, a ceiling, or the like can adapt to the deformation of the wall, the roof, the ceiling, or the like even when the wall, the roof, the ceiling, or the like is slightly deformed due to an earthquake, a strong wind, or the like, thus preventing the distortion of the panel.

DESCRIPTION OF EMBODIMENT

Hereinafter, an embodiment of the polygonal panel mounting structure according to the present invention will be described in detail with reference to the figures.

Figure 1:
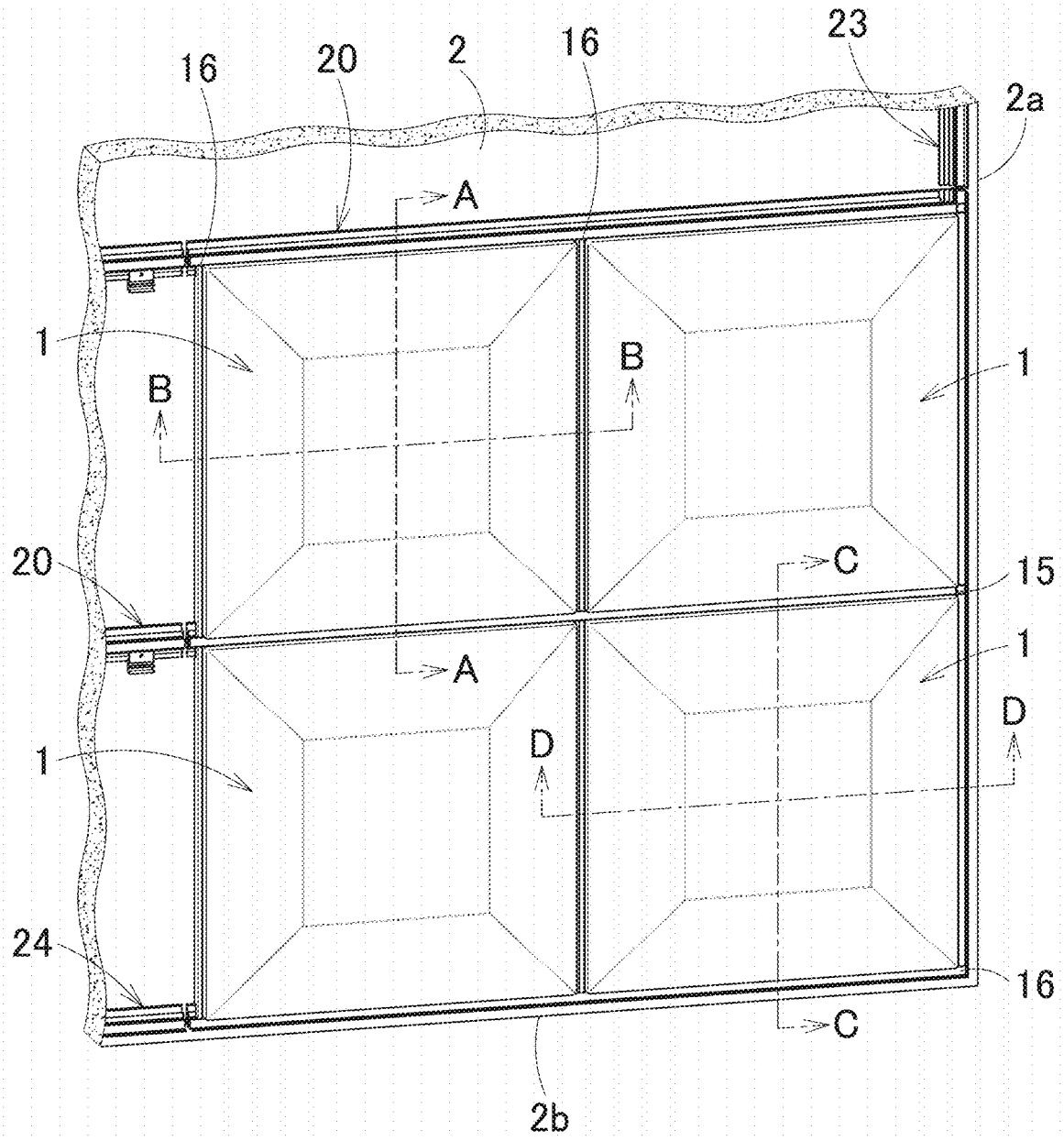
FIG. 1 is an external perspective view showing an embodiment of a polygonal panel mounting structure according to the present invention (in the case of a quadrilateral panel).
Figure 17:
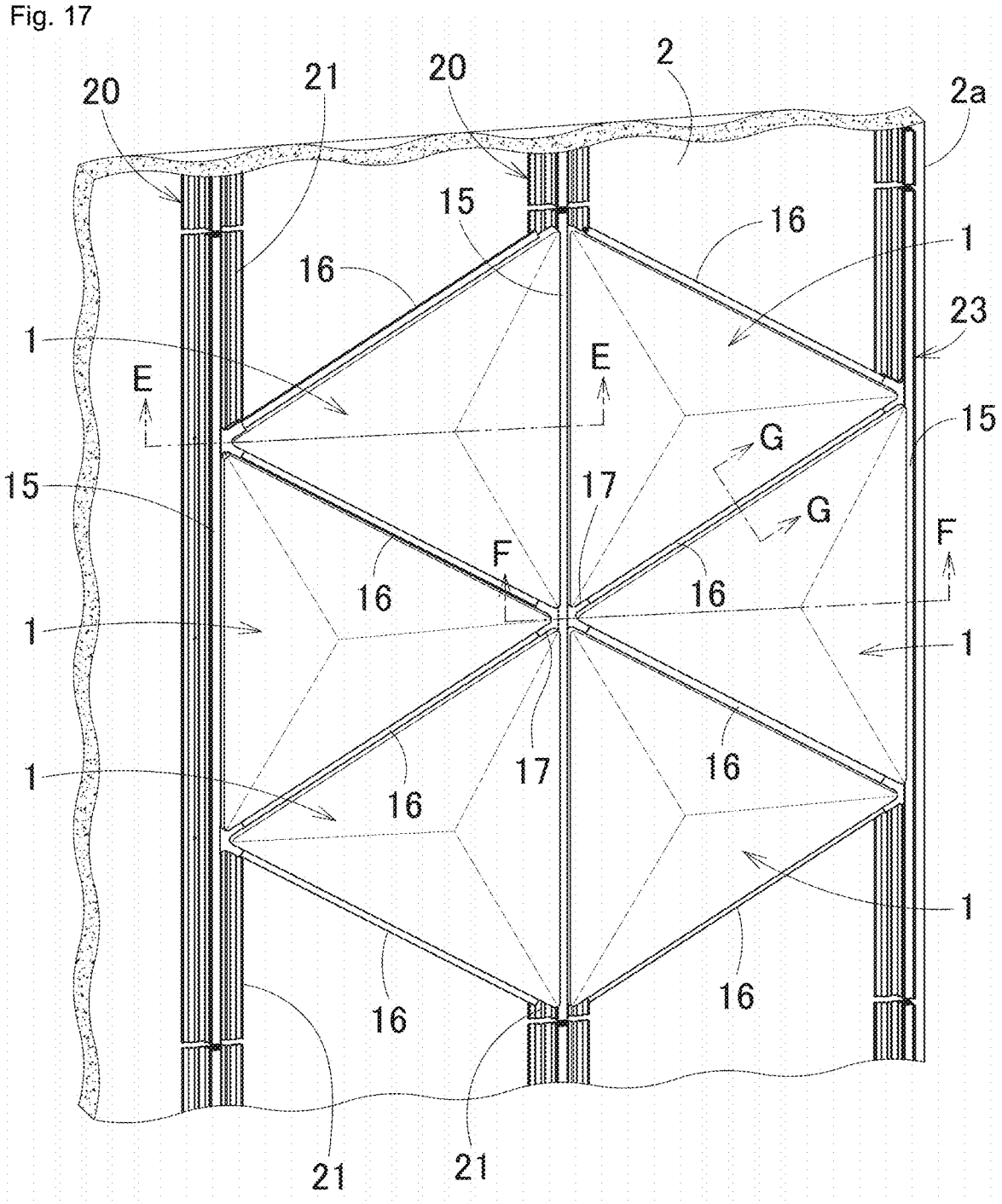
FIG. 17 is an external perspective view showing another embodiment of the polygonal panel mounting structure according to the present invention (in the case of a triangular panel).

In the polygonal panel mounting structure according to the present invention, as shown in FIG. 1 or FIG. 17, many polygonal panels 1 are mounted one by one on a mounting surface 2, such as a wall, a roof, or a ceiling (a wall surface is shown in the figure). Then, the mounting surface 2 is covered with many polygonal panels 1.

Figure 2:
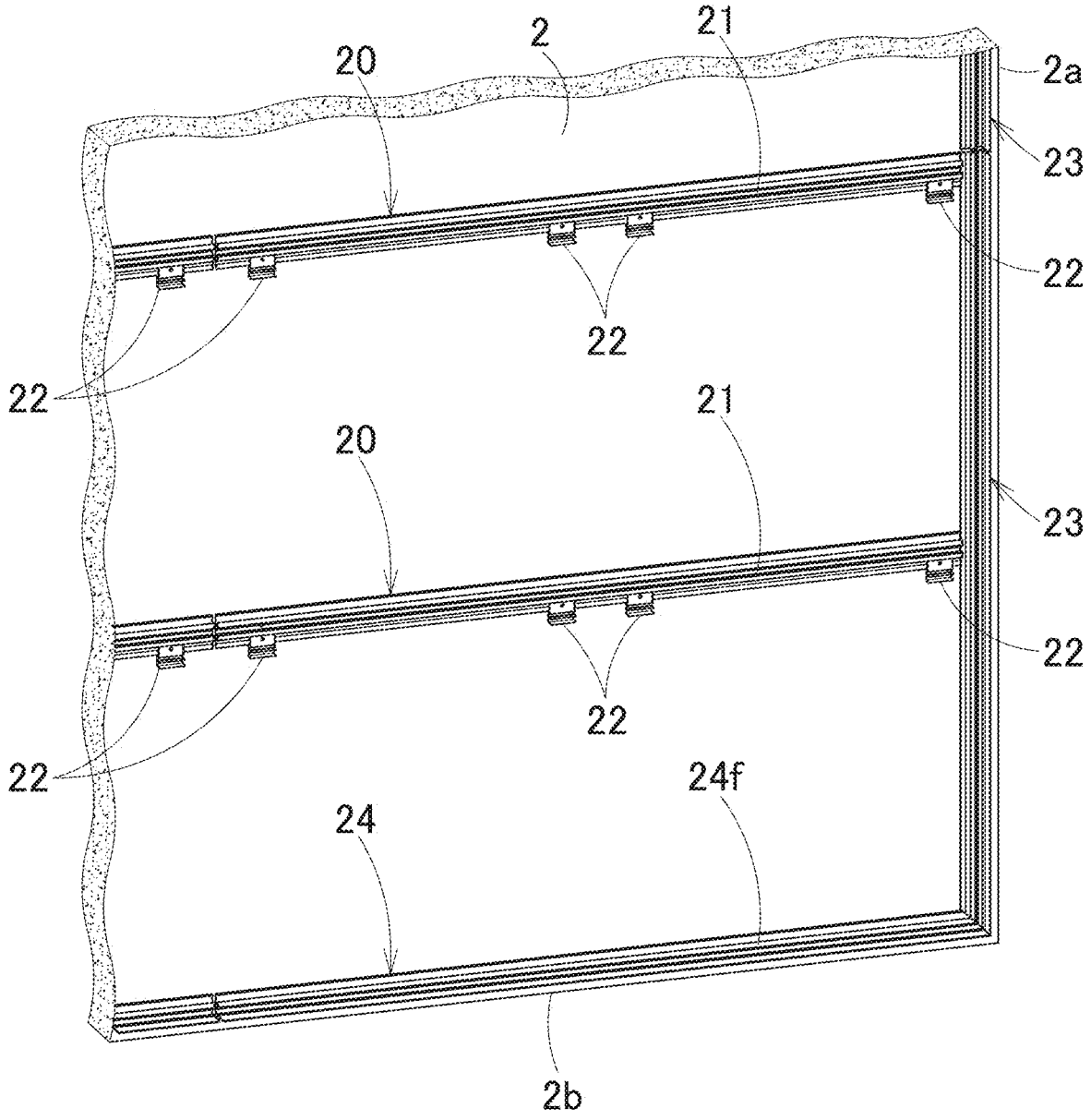
FIG. 2 is an external perspective view showing an arrangement state of a furring strip base frame, a fitting receiver, one-side-end base frame, and the other-side-end base frame attached to a wall surface in the polygonal panel mounting structure according to the present invention shown in FIG. 1.
Figure 3:
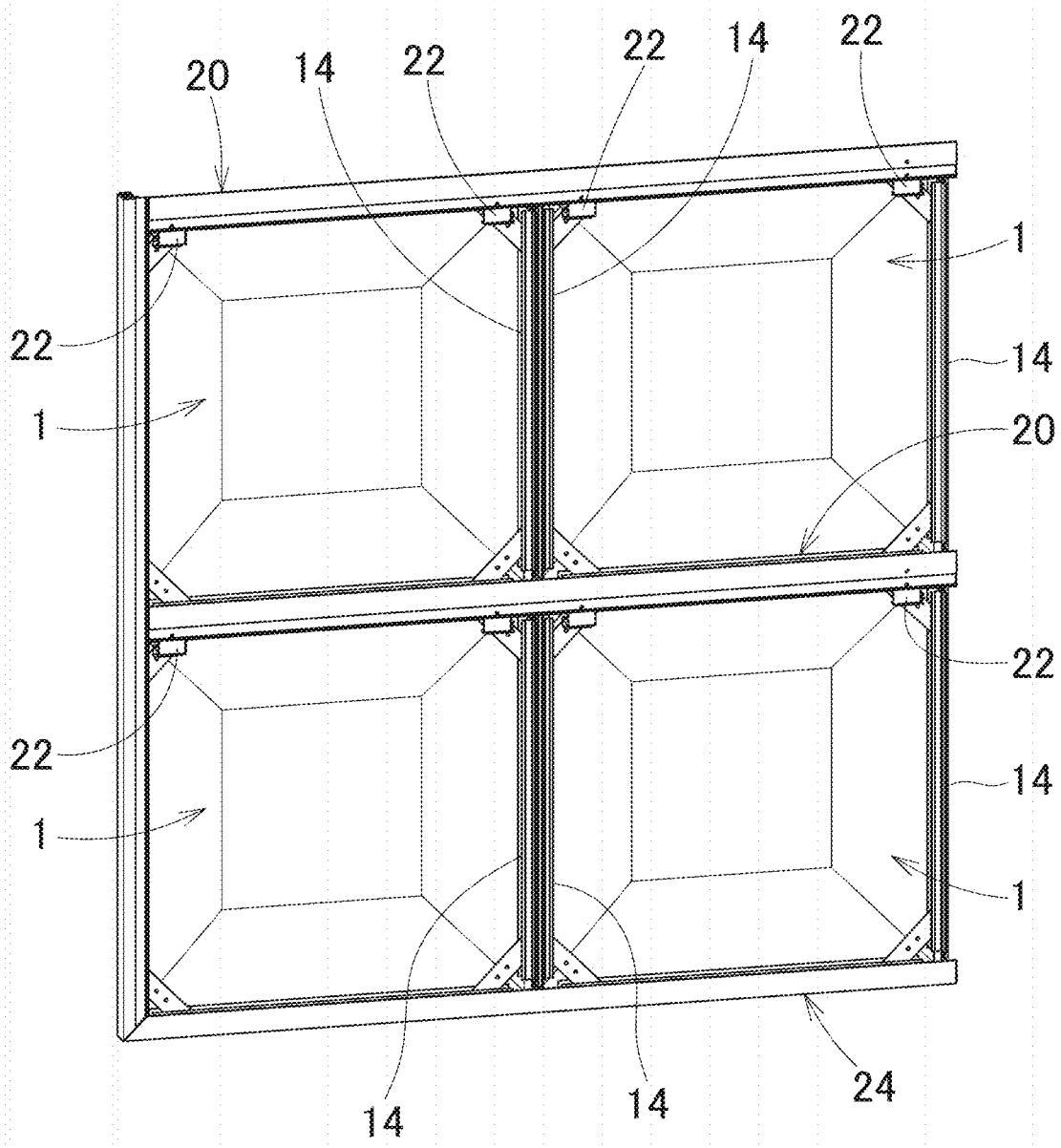
FIG. 3 is a perspective view of a state where, in the polygonal panel mounting structure according to the present invention shown in FIG. 1, a polygonal panel has been removed from the wall surface together with the furring strip base frame, the fitting receiver, the one-side-end base frame, and the other-side-end base frame attached to the wall surface shown in FIG. 2, as viewed from the back side.
Figure 4:
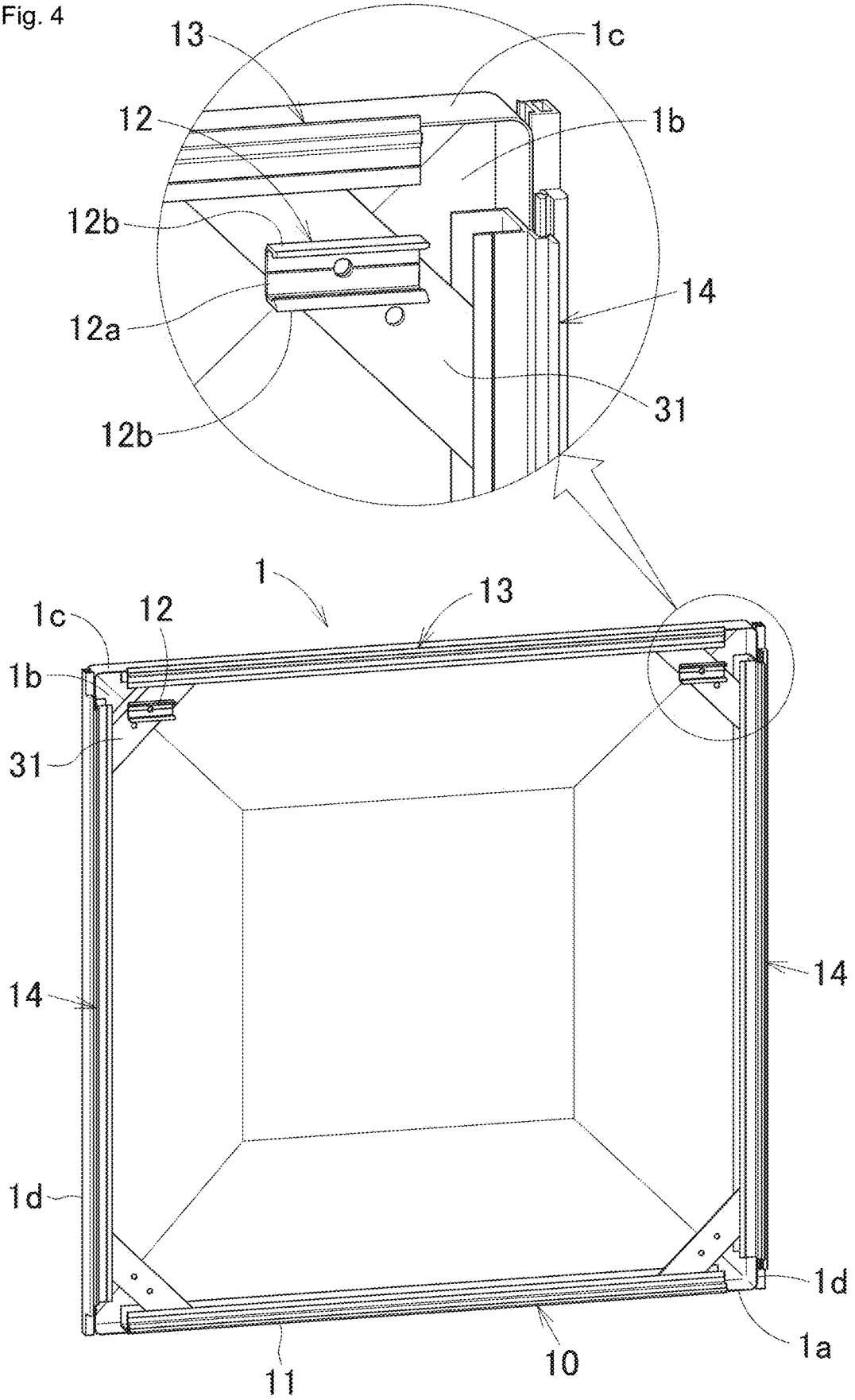
FIG. 4 is a perspective view of one of quadrilateral panels used in the polygonal panel mounting structure according to the present invention, as viewed from the back side.
Figure 5:
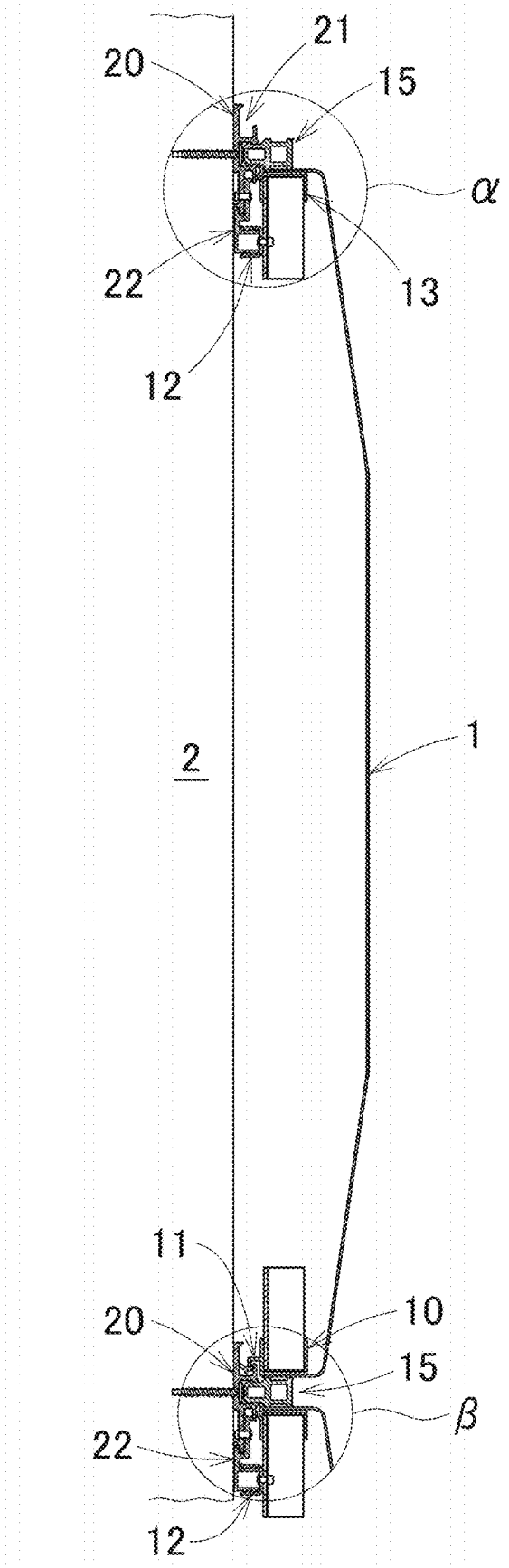
FIG. 5 is a cross-sectional view of the polygonal panel mounting structure according to the present invention, taken along line A-A in FIG. 1.
Figure 18:
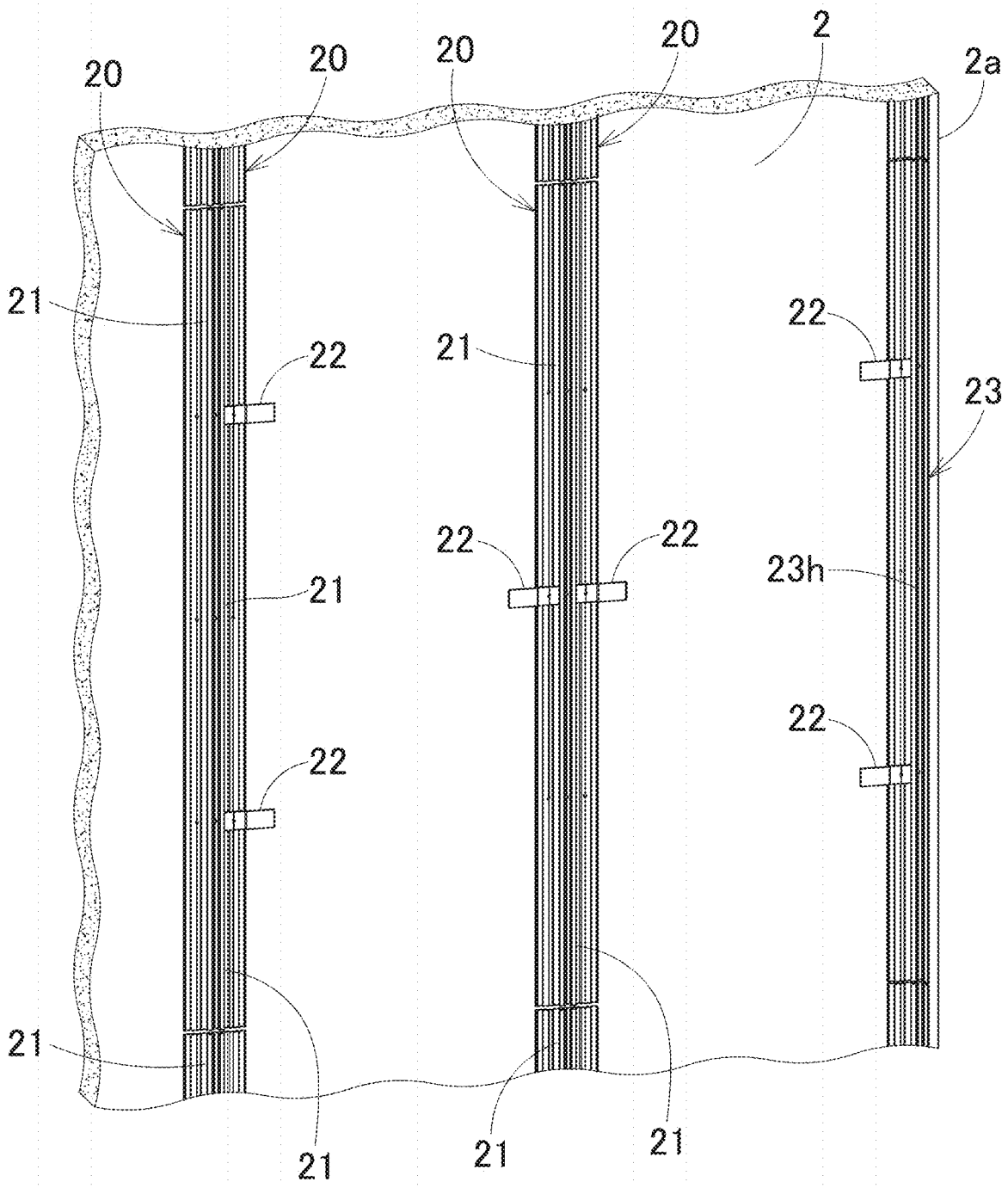
FIG. 18 is an external perspective view showing an arrangement state of a furring strip base frame, a fitting receiver, and a one-side-end base frame attached to the wall surface in the polygonal panel mounting structure according to the present invention shown in FIG. 17.
Figure 19:
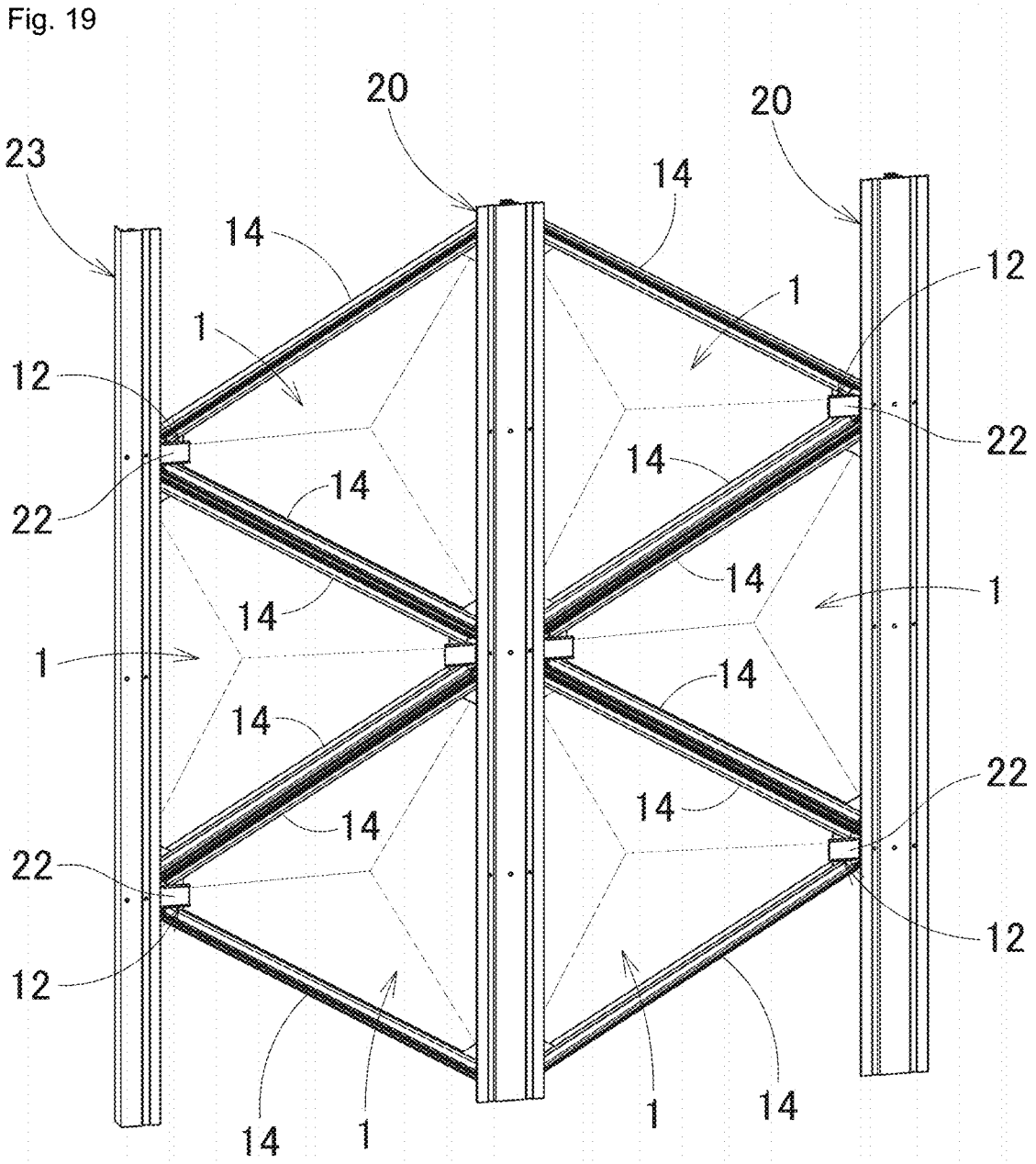
FIG. 19 is a perspective view of a state where, in the polygonal panel mounting structure according to the present invention shown in FIG. 17, a polygonal panel has been removed from the wall surface together with the furring strip base frame, the fitting receiver, and the one-side-end base frame attached to the wall surface shown in FIG. 18, as viewed from the back side.
Figure 20:
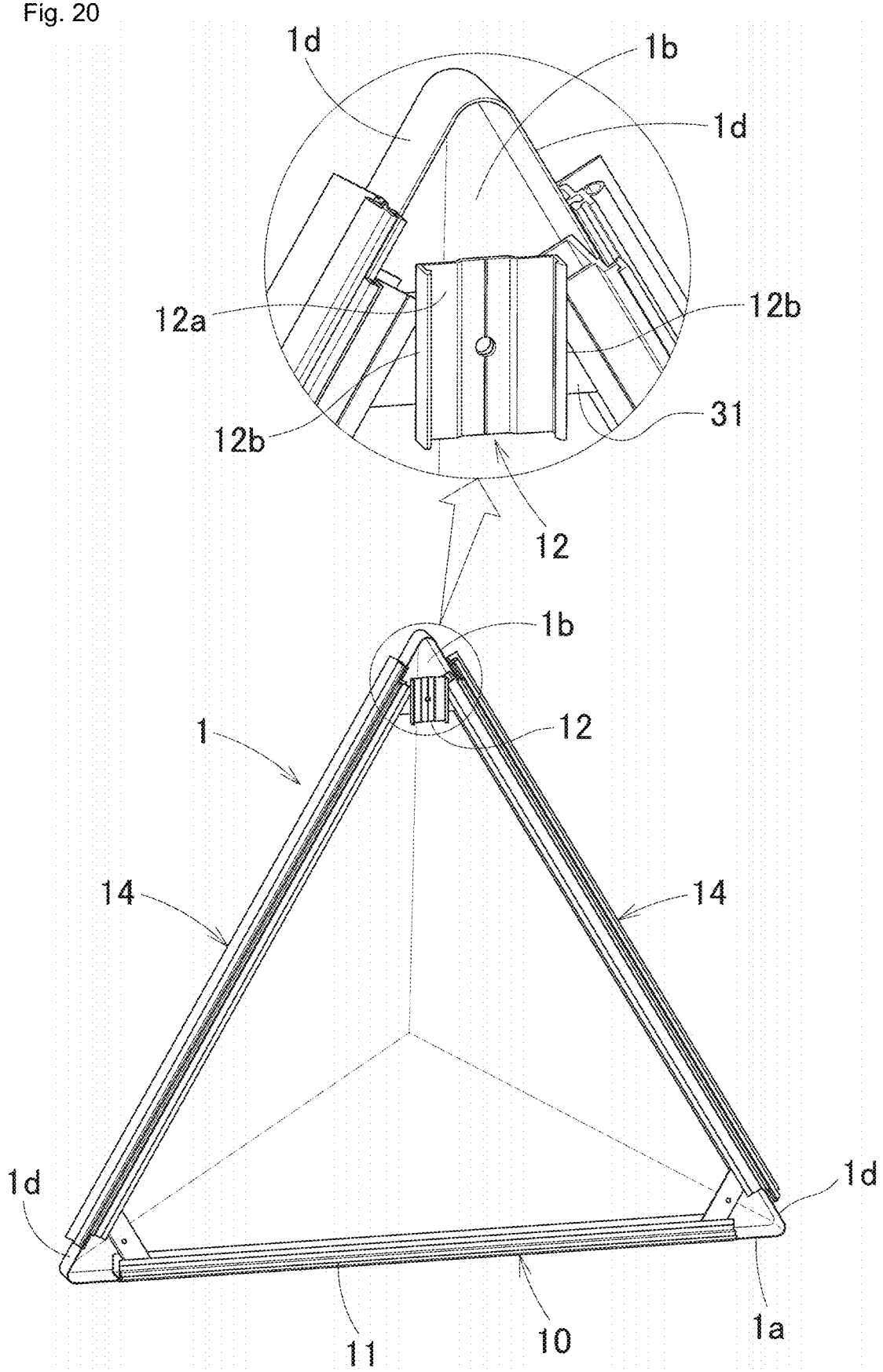
FIG. 20 is a perspective view of one of triangular panels used in the polygonal panel mounting structure according to the present invention, as viewed from the back side.
Figure 21:
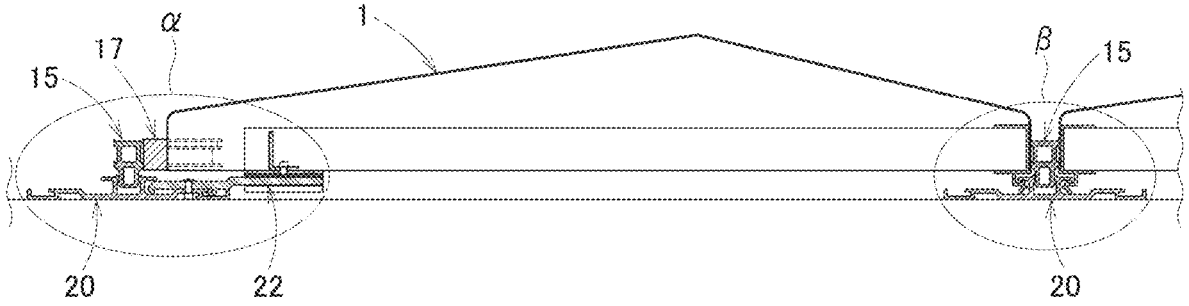
FIG. 21 is a cross-sectional view of the polygonal panel mounting structure according to the present invention, taken along line E-E in FIG. 17.

That is, in each of many polygonal panels 1, a fitting portion 11 of a fitting frame 10 provided on a one side portion 1*a* of the polygonal panel 1, as shown in FIGS. 4 and 20, is loosely fitted into a fitting groove 21 provided in one of furring strip base frames 20 that are fixed parallel to each other on the mounting surface 2 of the polygonal panel 1, as shown in FIGS. 2 and 18. Further, a fitting cap 12 provided at a corner 1*b*, facing the one side portion 1*a* of the polygonal panel 1, is fitted to a fitting receiver 22 that is provided so as to be swingable on the other of the furring strip base frames 20.

The polygonal panel 1 preferably has a planar shape that is a regular quadrilateral or a regular triangle. The polygonal panel 1 has a three-dimensional shape with a top surface and side surfaces, and the top surface is shown as having a shape of either a raised regular quadrangular pyramid or a raised regular triangular pyramid. In the present embodiment, a case where the planar shape of the polygonal panel 1 is a regular quadrilateral or a regular triangle has been described. However, the planar shape may be a quadrilateral other than the regular quadrilateral or a triangle other than the regular triangle, for example, a rhombus, a parallelogram, an isosceles trapezoid, a right triangle, an isosceles triangle, or the like. Further, the planar shape of the polygonal panel 1 may be a polygon other than a quadrilateral or a triangle, as required.

When the planar shape of the polygonal panel 1 is the regular quadrilateral, as shown in FIG. 4, the fitting frame 10 is provided on the one side portion 1*a*, the fitting caps 12 are provided at both corners 1*b*, 1*b* facing the one side portion 1*a*, an abutting frame 13 is provided on a one side portion 1*c* facing the one side portion 1*a*, and a mating frame 14 is provided on each of other side portions 1*d*, 1*d*.

As shown in FIGS. 1 and 2, a plurality of furring strip base frames 20 are fixed horizontally parallel to each other on the mounting surface 2. The fitting portion 11 of the fitting frame 10 of the polygonal panel 1 is loosely fitted in the fitting groove 21 of the furring strip base frame 20 at an intermediate portion that is not adjacent to a one-side-end portion 2*a* of the mounting surface 2 or an other-side-end portion 2*b* adjacent to the one-side-end portion 2*a*. Further, the fitting cap 12 of the polygonal panel 1 is fitted to the fitting receiver 22 that is provided so as to be swingable on the other of the furring strip base frames 20.

Figure 33:
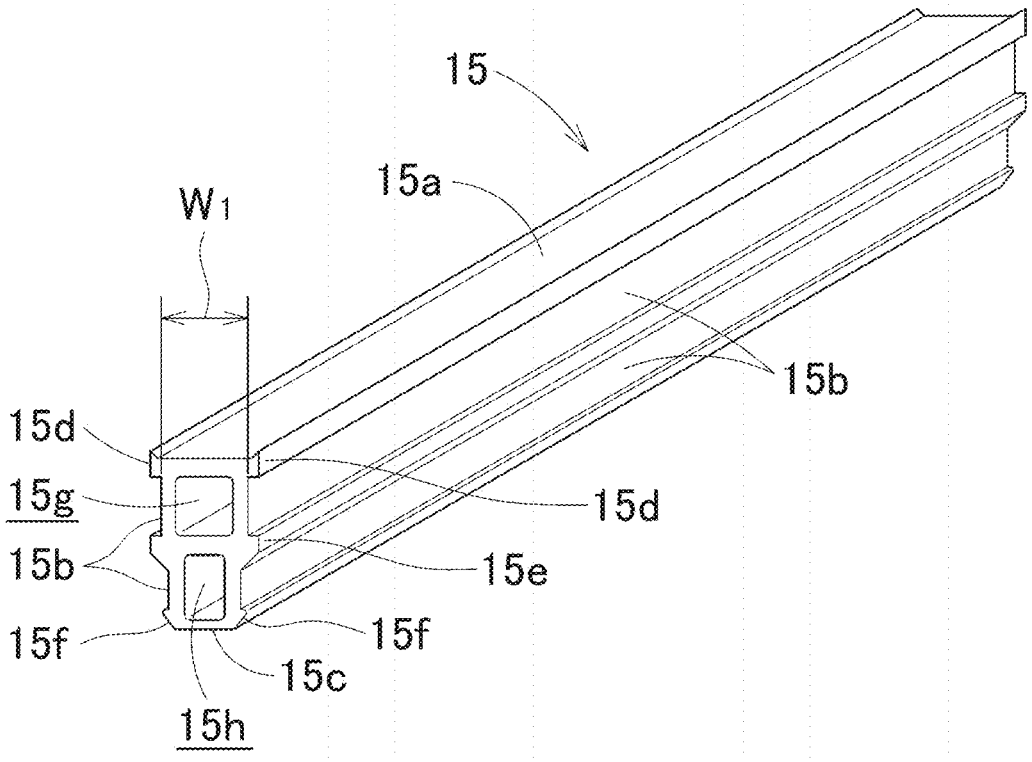
FIG. 33 is a perspective view of a gasket attached between the polygonal panels mounted on the wall surface or to a side end of the polygonal panel.
Figure 34:
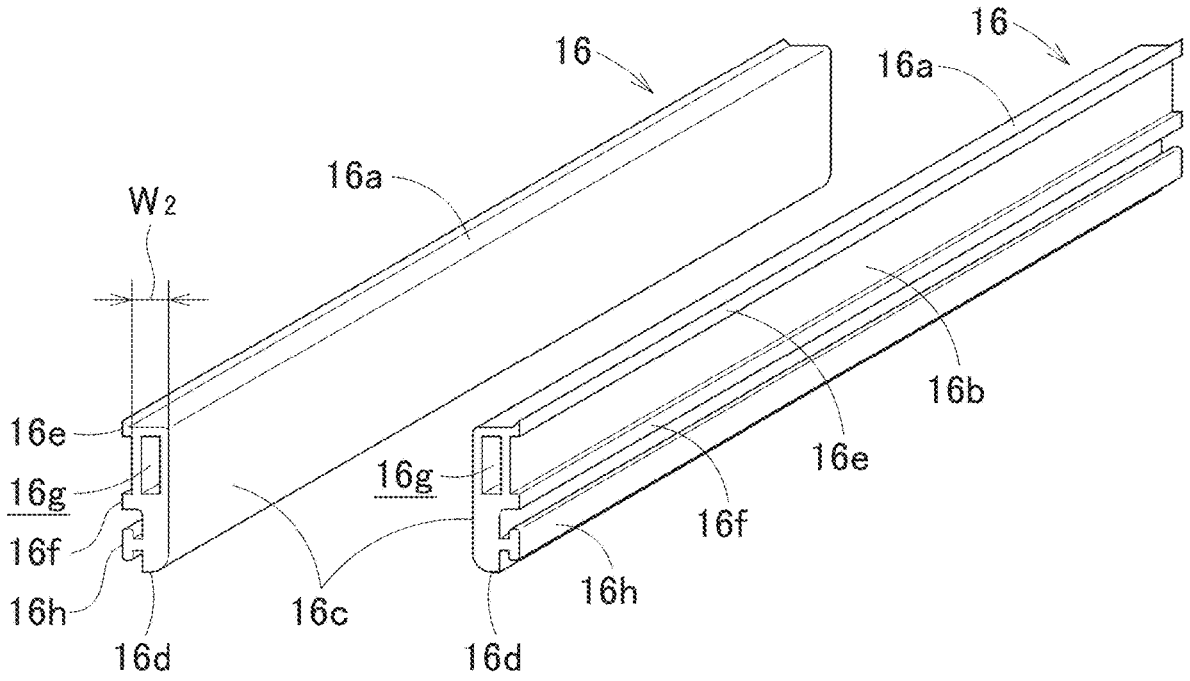
FIG. 34 is a perspective view of a gasket attached between the polygonal panels mounted on the wall surface.

Moreover, as shown in FIGS. 1 and 5 to 16, a gasket, stretchable in the width direction, is attached between each of many polygonal panels 1 mounted on the mounting surface 2. That is, in FIG. 1, a gasket 15 (cf. FIG. 33), which is one member, is attached to seal the gap between the upper and lower polygonal panels 1 or seal the gap at the side end of the polygonal panel 1 located at the side-end portion 2*a* of the mounting surface 2, and a gasket 16 (cf. FIG. 34), made up of two members for sealing the gap between the left and right polygonal panels 1, is attached.

Figure 11:
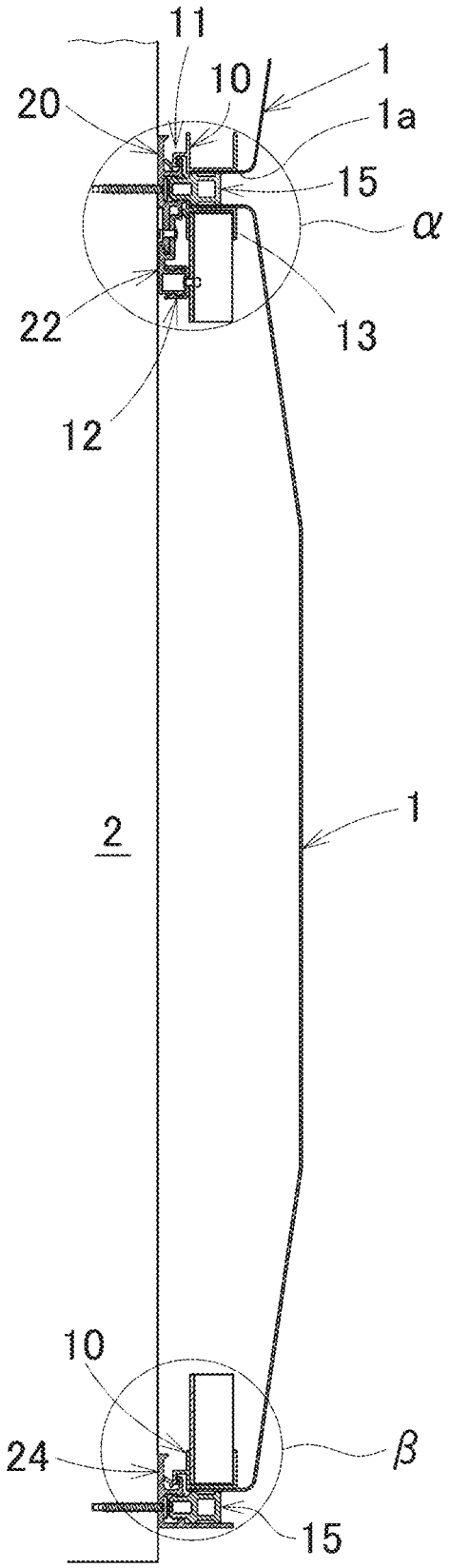
FIG. 11 is a cross-sectional view of the polygonal panel mounting structure according to the present invention, taken along line C-C in FIG. 1.
Figure 13:
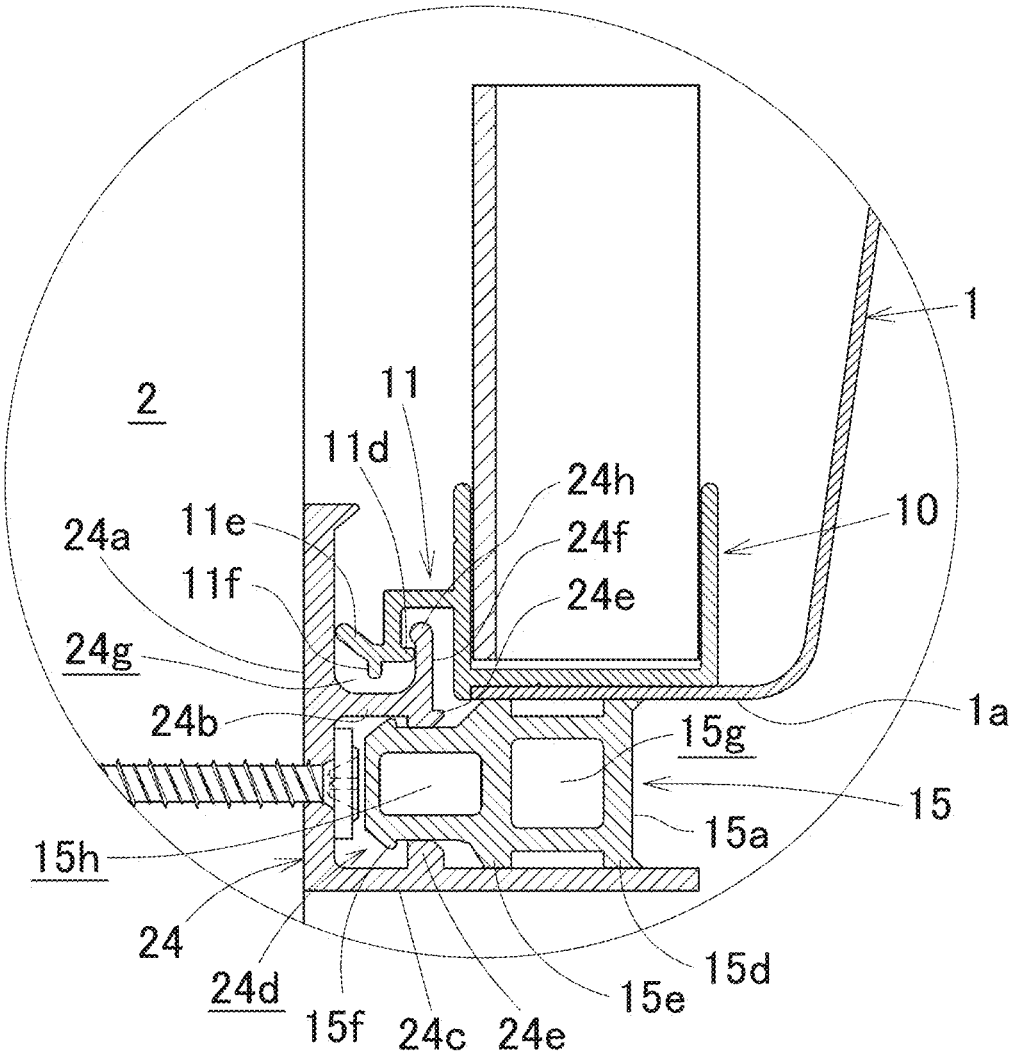
FIG. 13 is an enlarged view of a portion β surrounded by a circle in FIG. 11.
Figure 14:
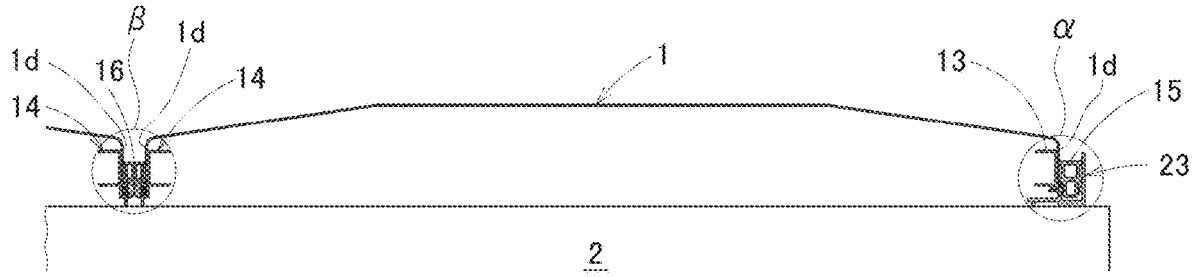
FIG. 14 is a cross-sectional view of the polygonal panel mounting structure according to the present invention, taken along line D-D in FIG. 1.
Figure 15:
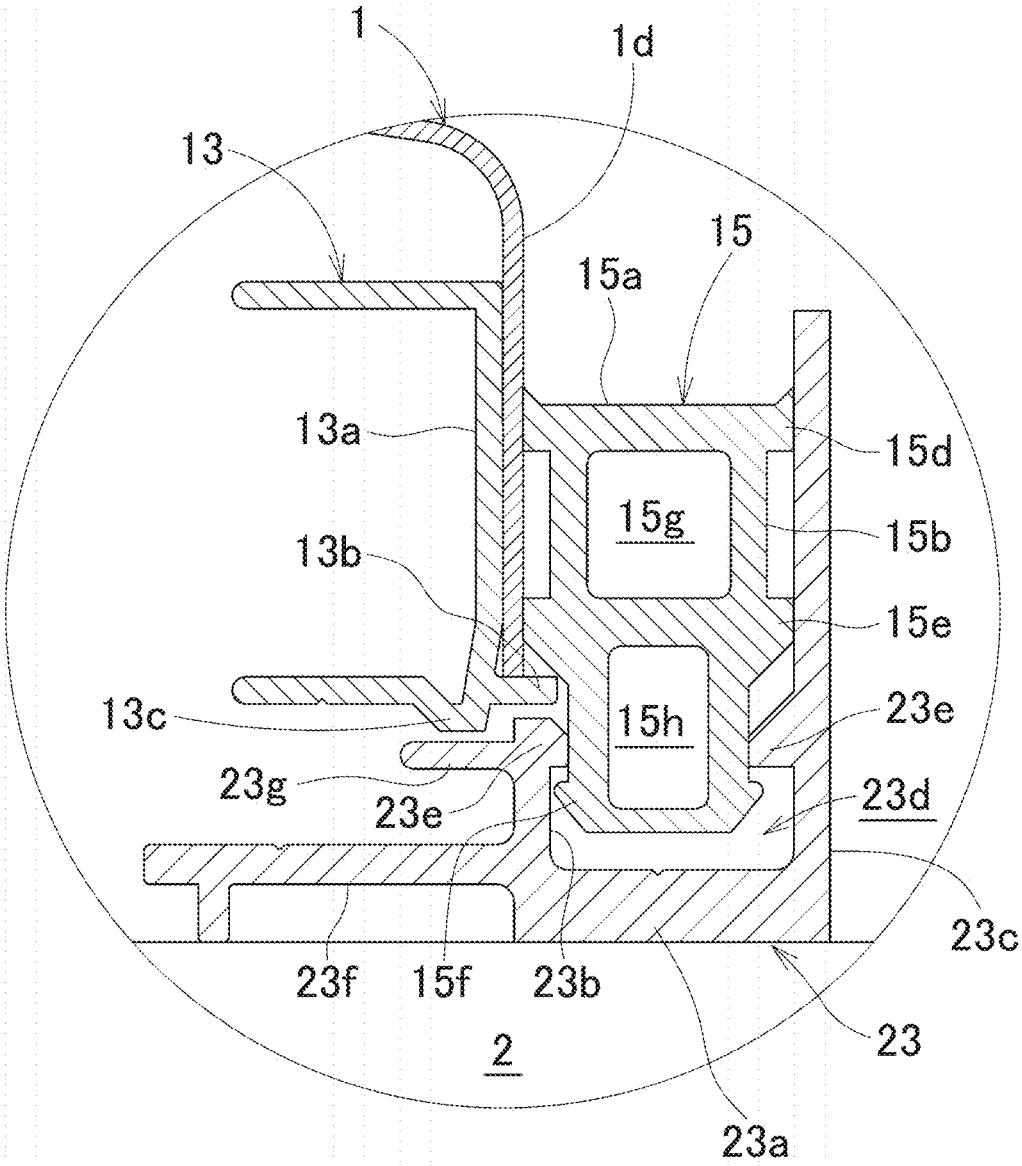
FIG. 15 is an enlarged view of a portion α surrounded by a circle in FIG. 14.

Note that a one-side-end base frame 23 is fixed vertically to the one-side-end portion 2*a* of the mounting surface 2, and an other-side-end base frame 24 is fixed to the other-side-end portion 2*b* of the mounting surface 2 in place of the furring strip base frame 20. In a portion of the polygonal panel 1 that is attached to the side end of the mounting surface 2, as shown in FIGS. 14 and 15, one of the mating frames 14 of the polygonal panel 1 serves as the abutting frame 13, and the abutting frame 13 is abutted against the one-side-end base frame 23. Further, in a portion of the polygonal panel 1 that is attached to the other side end of the mounting surface 2, as shown in FIGS. 11 and 13, the fitting portion 11 of the fitting frame 10 is loosely fitted in a fitting groove 24*g* of the other-side-end base frame 24.

When the planar shape of the polygonal panel 1 is the regular triangle, as shown in FIG. 20, a fitting frame 10 is provided on a one side portion 1*a*, a fitting cap 12 is provided at a corner 1*b* facing the one side portion 1*a*, and a mating frame 14 is provided on each of other side portions 1*d*, 1*d*.

As shown in FIGS. 17 and 18, a plurality of furring strip base frames 20 are fixed vertically parallel to each other on the mounting surface 2. In the polygonal panel 1, a fitting portion 11 of the fitting frame 10 is loosely fitted in the fitting groove 21 of a furring strip base frame 20 at an intermediate portion not adjacent to the one-side-end portion 2*a* or the other-side-end portion 2*b* of the mounting surface 2. Further, the fitting cap 12 of the polygonal panel 1 is fitted to the fitting receiver 22 that is provided so as to be swingable on the other of the furring strip base frames 20.

Moreover, as shown in FIGS. 17 and 21 to 27, a gasket, stretchable in the width direction, is fitted between each of many polygonal panels 1 mounted on the mounting surface 2. That is, in FIG. 17, the gasket 15 (cf. FIG. 33), which is one member for sealing the gap between the left and right polygonal panels 1, is attached, and the gasket 16 (cf. FIG. 34), made up of two members for sealing the gap between the upper and lower polygonal panels 1, is attached. Further, a gasket 17 (cf. FIG. 35), which is one member for sealing the joint at the corner of the polygonal panel 1, is attached.

Figure 24:
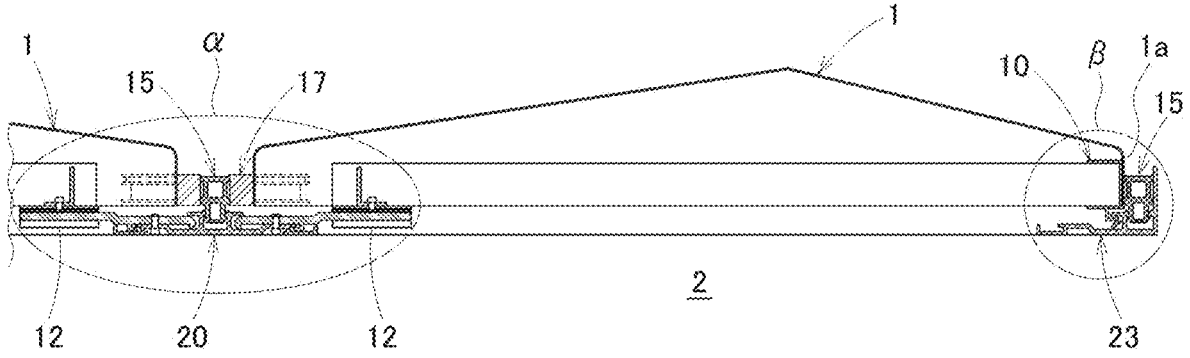
FIG. 24 is a cross-sectional view of the polygonal panel mounting structure according to the present invention, taken along line F-F in FIG. 17.
Figure 26:
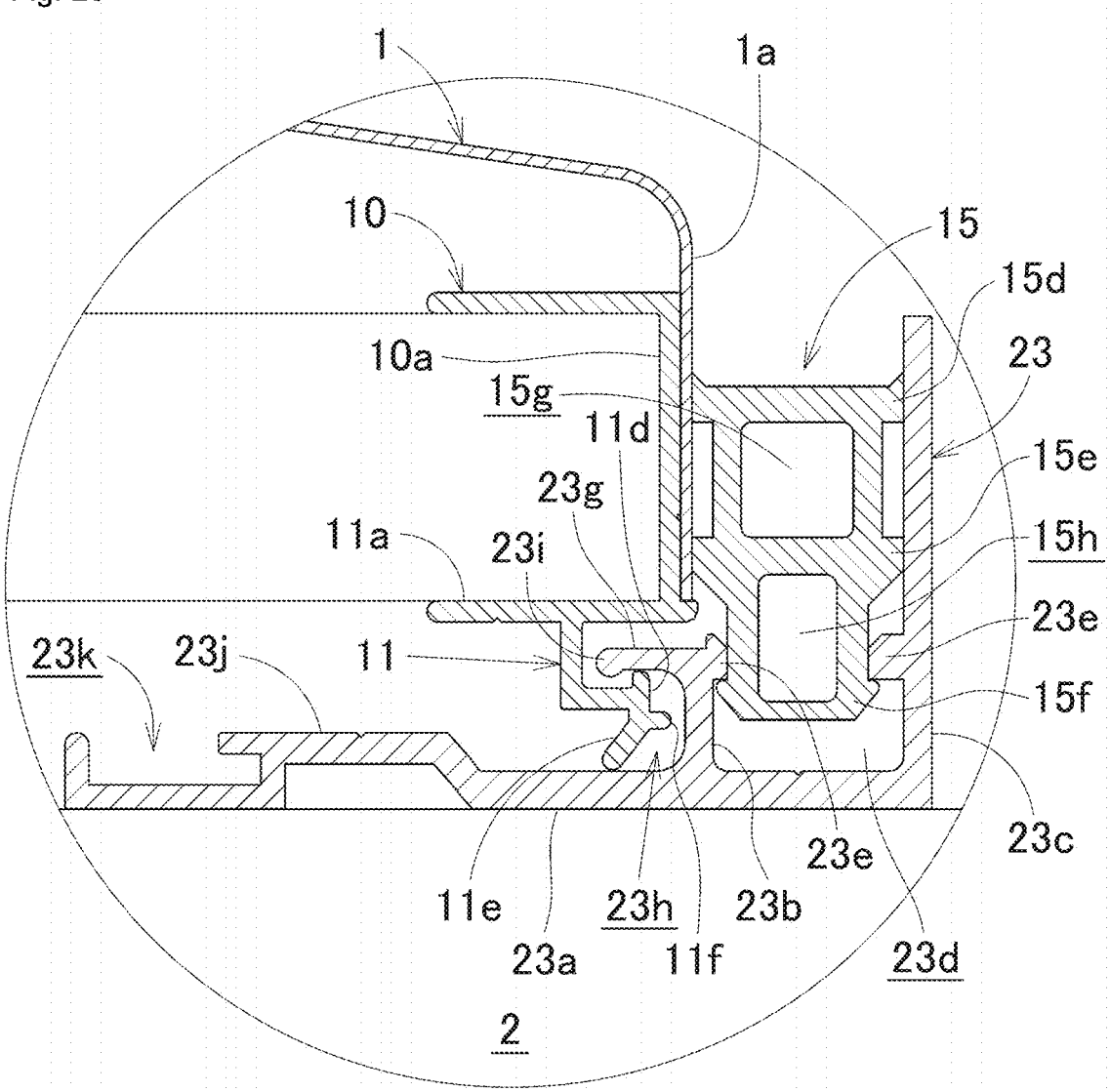
FIG. 26 is an enlarged view of a portion β surrounded by a circle in FIG. 24.

Note that a one-side-end base frame 23 is fixed vertically to the side-end portion 2*a* of the mounting surface 2. In a portion of the polygonal panel 1 to be attached to the side end of the mounting surface 2, as shown in FIGS. 24 and 26, the fitting portion 11 of the fitting frame 10 provided on the one side portion 1*a* is loosely fitted in a fitting groove 23*h* of the one-side-end base frame 23.

As shown in FIGS. 7, 12, 13, 23, 26, and 28, the fitting frame 10 has an attachment surface portion 10*a* to be attached to the inner side of the one side portion 1*a* of the polygonal panel 1. The fitting portion 11 of the fitting frame 10 includes a first flat portion 11*a* projecting parallel to the mounting surface 2, such as a wall surface, from the attachment surface portion 10*a*, a second flat portion 11*b* projecting at a right angle to the mounting surface 2 from the first flat portion 11*a*, a third flat portion 11*c* projecting at a right angle from the side end of the second flat portion 11*b*, and the like. The fitting portion 11 of the fitting frame 10 inwardly includes, at the outer end of the third flat portion 11*c*, a first rib 11*d* projecting parallel to the second flat portion 11*b*. The fitting portion 11 outwardly includes, at the outer end of the third flat portion 11*c*, an inclined rib 11*e* angled at 30 to 60 degrees with respect to the third flat portion 11*c*, and further includes, at the base end of the inclined rib 11*e*, a second rib 11*f* projecting at a right angle to the second flat portion 11*b*.

The fitting cap 12 is shown in FIGS. 4, 6, 7, 12, and 29 when the planar shape of the polygonal panel 1 is the regular quadrilateral, and is shown in FIGS. 20, 22, 25, and 30 when the planar shape of the polygonal panel 1 is the regular triangle. Specifically, in the fitting cap 12, an attachment surface portion 12*a* is attached to a reinforcing member 31, provided at the corner 1*b* of the polygonal panel 1, by rivets or the like so as to be swingable. Opposite surface portions 12*b*, 12*b* project parallel to each other from both side ends of the attachment surface portion 12*a* in an elastically deformable manner, and retaining ribs 12*c*, 12*c* are formed on the inner sides of the outer ends of the opposite surface portions 12*b*, 12*b*, respectively.

The abutting frame 13 is used when the planar shape of the polygonal panel 1 is the regular quadrilateral. In the abutting frame 13, as shown in FIGS. 6, 7, 12, and 31, on an attachment surface portion 13*a* to be attached to the inner side of the one side portion 1*c* of the polygonal panel 1, a rib 13*b* projecting parallel to the mounting surface 2, such as the wall surface, from the side end of the attachment surface portion 13*a*, and rib 13*c* projecting at a right angle to the mounting surface 2 are formed. Further, as shown in FIG. 15, on the attachment surface portion 13*a* to be attached to the inner side of the other side portion 1*d* of the polygonal panel 1, the abutting frame 13 has the rib 13*b* projecting parallel to the mounting surface 2, such as the wall surface, from the side end of the attachment surface portion 13*a*, and the rib 13*c* projecting at a right angle to the mounting surface 2.

In the mating frame 14, as shown in FIGS. 9, 10, 16, 27, and 32, on an attachment surface portion 14*a* to be attached to the inner sides of the other side portions 1*d*, 1*d* of the polygonal panel 1, a flat portion 14*b* projecting parallel to the attachment surface portion 14*a* and a groove portion 14*e* surrounded by flat portions 14*c*, 14*d* projecting at right angles from both side ends of the flat portions 14*b* are formed. Retaining ribs 14*f*, 14*f* of the gasket 16 are formed on the inner sides of side ends of the flat portions 14*c*, 14*d*, respectively, and an installation rib 14*g* for the mounting surface 2 is formed on the outer side of the side end of the flat portion 14*d*.

The gasket 15 is made of an elastically deformable synthetic resin or the like, and as shown in FIGS. 6, 7, 12, 13, 15, 22, 23, 25, 26, and 33, the gasket 15 is a long member with a cross section in an elongated, substantially quadrilateral shape, formed of a top surface portion 15*a*, two side surface portions 15*b*, 15*b*, and a bottom surface portion 15*c*. In the gasket 15, retaining ribs 15*d*, 15*e*, 15*f* are formed in the upper, middle, and lower sections of both side surface portions 15*b*, and on the inner side, two deformation passages 15*g*, 15*h* having a substantially quadrilateral cross-sectional shape are formed. When a pressing force is applied in the width direction of the gasket 15, the deformation passages 15*g*, 15*h* are deformed, and a width W1 of the gasket 15 is reduced to about a half.

The gasket 16 is made of an elastically deformable synthetic resin or the like. As shown in FIGS. 9, 10, 16, 27, and 34, the gasket 16 is formed of divided bodies that are mirror images of each other (optically non-symmetrical), each being a long member with a cross section in an elongated, substantially quadrilateral shape, formed of a top surface portion 16*a*, a side surface portion 16*b*, a contact surface portion 16*c*, and a bottom surface portion 16*d*. In the gasket 16, retaining ribs 16*e*, 16*f* are formed in the upper and middle sections of each side surface portion 16*b*, and a deformation passage 16*g* having a substantially quadrilateral cross section is formed in the upper section. When a pressing force is applied in the width direction of the gasket 16, the deformation passage 16*g* is deformed and a width W2 of the gasket 16 is reduced to about a half. Further, a retaining rib 16*h* projecting from the side surface portion 16*b* is formed at the lower section of the side surface portion 16*b* of the gasket 16. As shown in FIGS. 9, 10, 16, and 27, the retaining rib 16*h* is inserted or fitted into the groove portion 14*e* of the mating frame 14, whereby the gasket 16 is attached to the mating frame 14.

Figure 22:
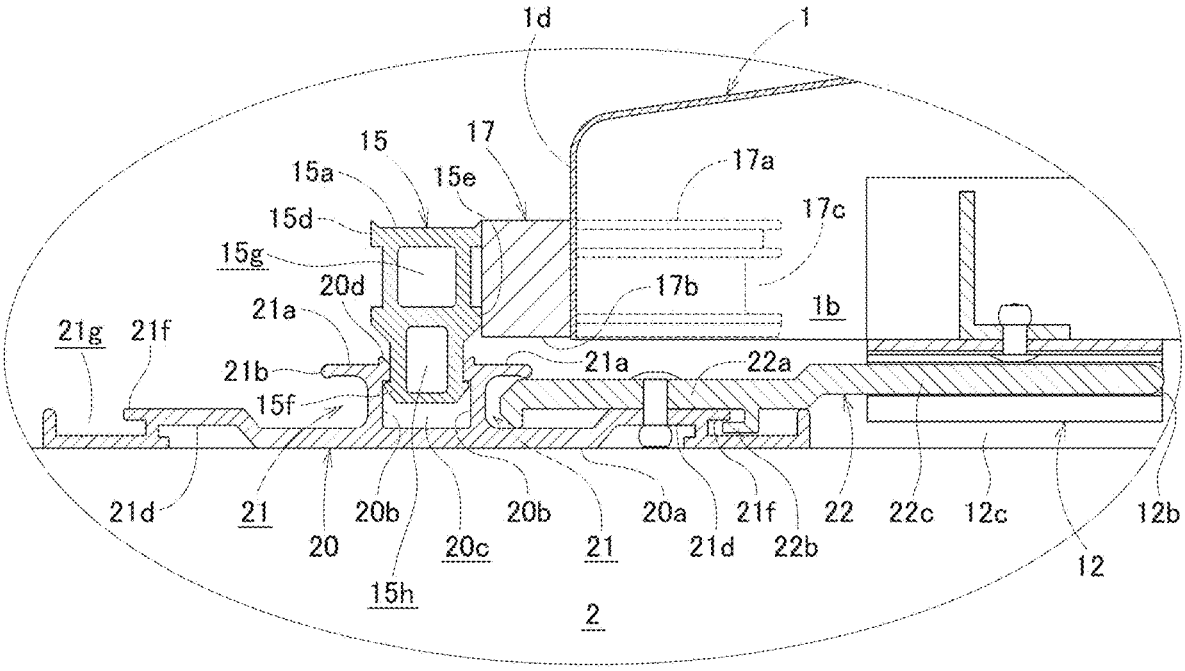
FIG. 22 is an enlarged view of a portion α surrounded by a circle in FIG. 21.
Figure 25:
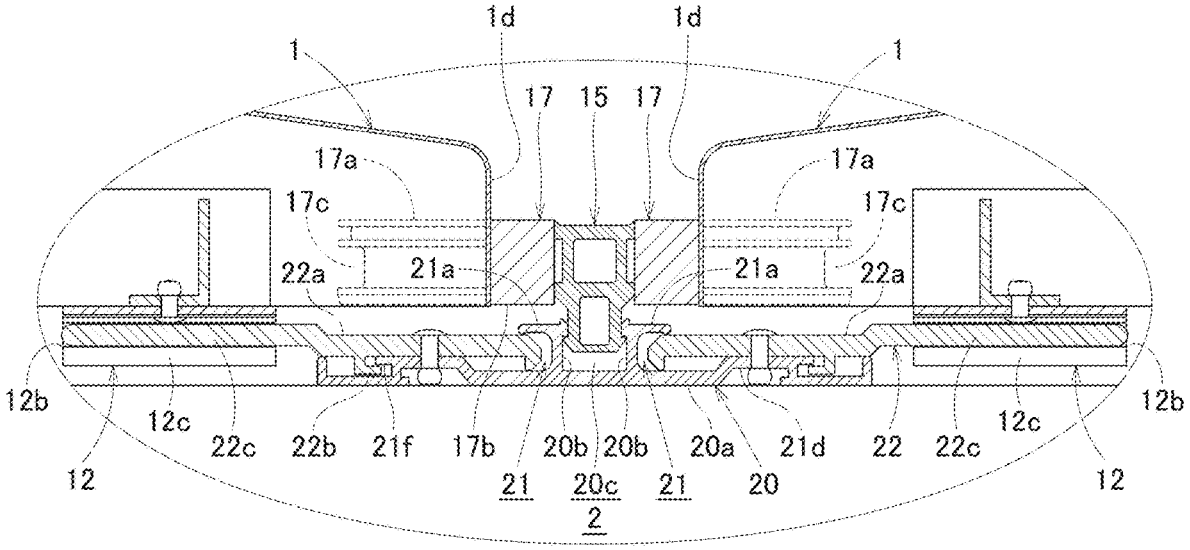
FIG. 25 is an enlarged view of a portion α surrounded by a circle in FIG. 24.
Figure 35:
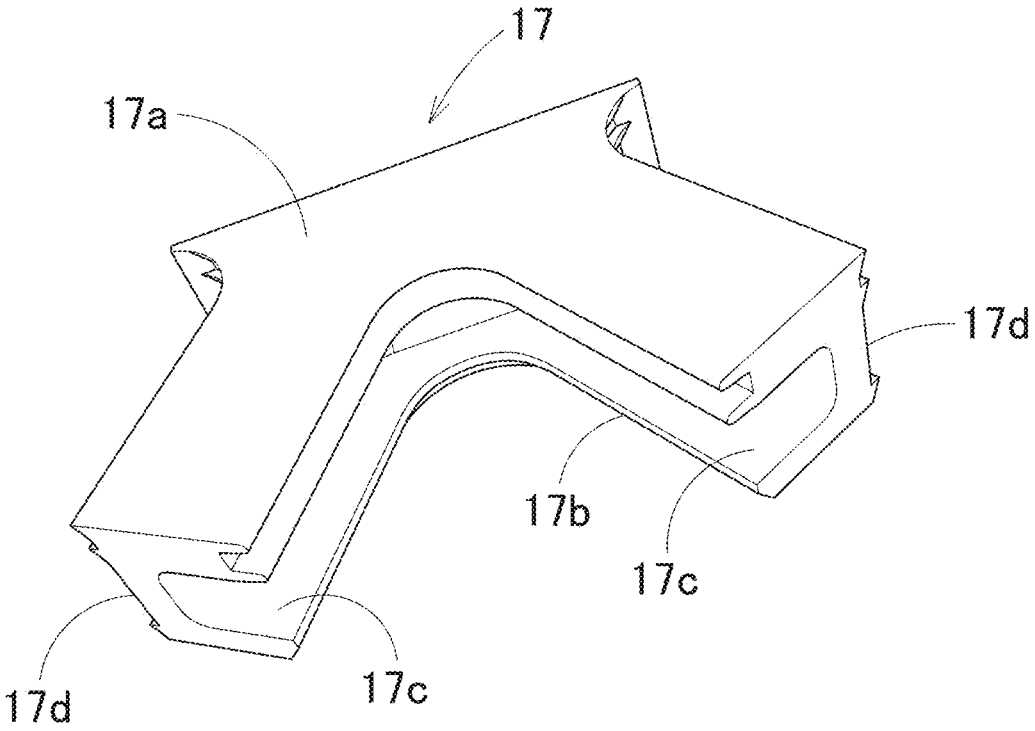
FIG. 35 is a perspective view of a gasket attached to a corner of the triangular panel attached to the wall surface.
Figure 36:
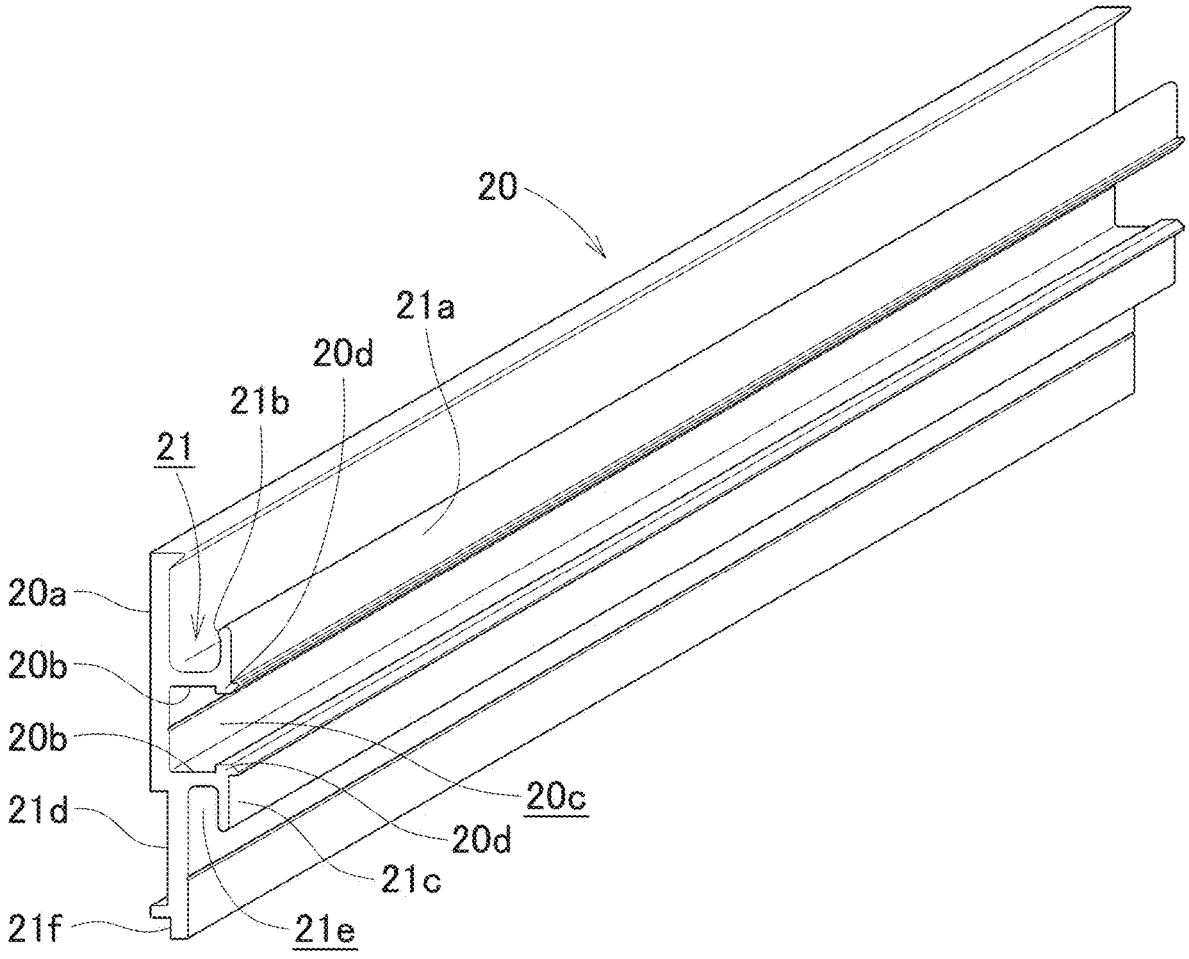
FIG. 36 is a perspective view of the furring strip base frame of the quadrilateral panel fixed to the wall surface.

The gasket 17 is used when the planar shape of the polygonal panel 1 is the regular triangle, and is a member made of an elastically deformable synthetic resin or the like. In the gasket 17, as shown in FIGS. 22, 25 and 35, a fitting groove 17*c* to be fitted along the corner 1*b* of the polygonal panel 1 is provided on the inner side between a top surface portion 17*a* and a bottom surface portion 17*b* having a planar shape with a folded-linear feature. A fitting groove 17*d* to be fitted along the corner 1*b* of the adjacent triangular panel is provided on the outer side between the top surface portion 17*a* and the bottom surface portion 17*b*.

As shown in FIGS. 6, 7, 12, and 36, when the planar shape of the polygonal panel 1 is the regular quadrilateral, the furring strip base frame 20 has a fixed surface portion 20*a* to be fixed to a mounting surface 2, such as the wall surface. A gasket fitting groove 20*c* is formed between opposite surface portions 20*b*, 20*b* projecting from the fixed surface portion 20*a*. In the fitting groove 21 of the furring strip base frame 20, retaining ribs 20*d*, 20*d* are formed on the inner sides of side ends of the opposite surface portions 20*b*, 20*b*. The fitting groove 21 of the furring strip base frame 20 is surrounded by the fixed surface portion 20*a*, a flat portion 21*a* parallel to the fixed surface portion 20*a*, and one of the opposite surface portions 20*b*. When the mounting surface 2 is deformed due to an earthquake, a strong wind, or the like, a first rib 11*d* of the fitting portion 11 of the polygonal panel 1 slides on the flat portion 21*a* including a retaining rib 21*b*, engaged with the first rib 11*d*, at the outer end, and an inclined rib 11*e* of the fitting portion 11 slides on the fixed surface portion 20*a*, whereby a second rib 11*f* of the fitting portion 11 is attachable to and detachable from the opposite surface portion 20*b*. In the furring strip base frame 20, two flat portions 21*c*, 21*d* parallel to the fixed surface portion 20*a* project from the other of the opposite surface portions 20*b*. An insertion portion 22*a* of the fitting receiver 22 to be described later is inserted into the fitting groove 21*e* surrounded by the two flat portions 21*c*, 21*d* and the opposite surface portion 20*b*, and the insertion portion 22*a* is pivotally supported by a rivet or the like on the flat portion 21*d*, so that the fitting receiver 22 is attached so as to be swingable. Further, an engagement projection 21*f* is provided at the outer end of the flat portion 21*d* of the furring strip base frame 20, and the engagement projection 21*f* is engaged in a slidable manner with an engagement projection 22*b* of the fitting receiver 22 to be described later. In this way, the fitting receiver 22 can be swung without shaking, and when a separating force acts between the fitting receiver 22 and the furring strip base frame 20, the fitting receiver 22 and the furring strip base frame 20 are prevented from being separated by the separating force.

Figure 23:
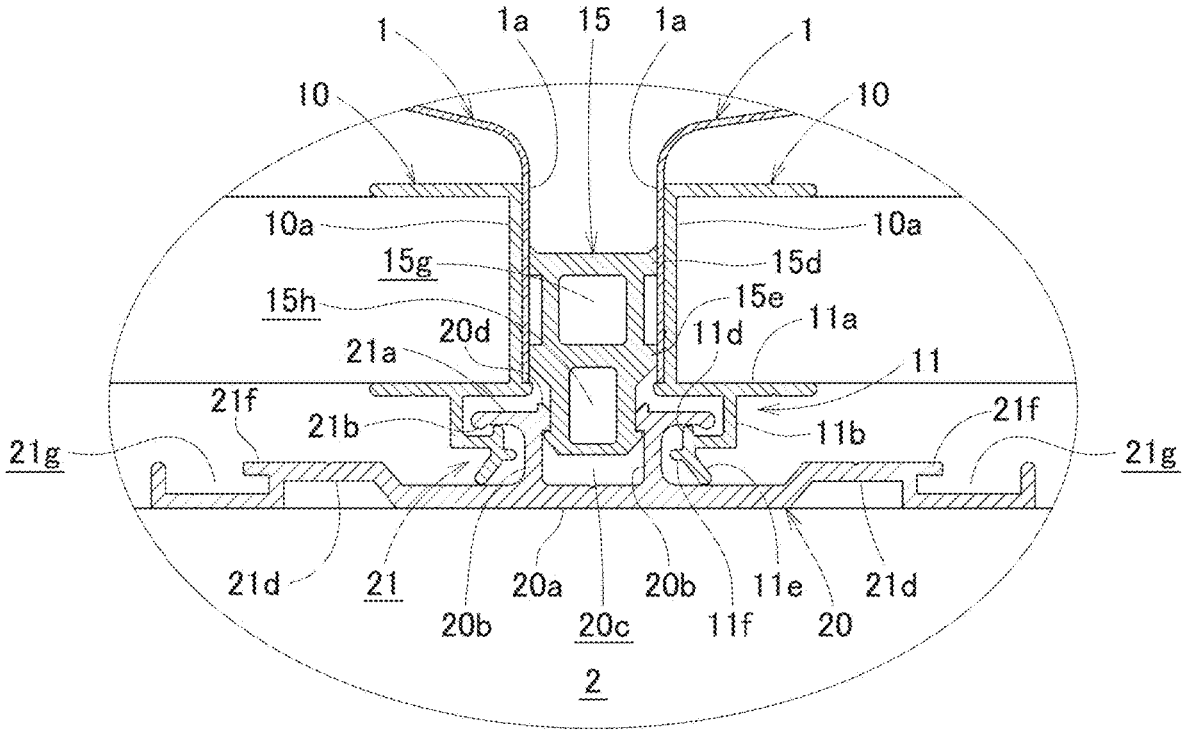
FIG. 23 is an enlarged view of a portion β surrounded by a circle in FIG. 21.
Figure 37:
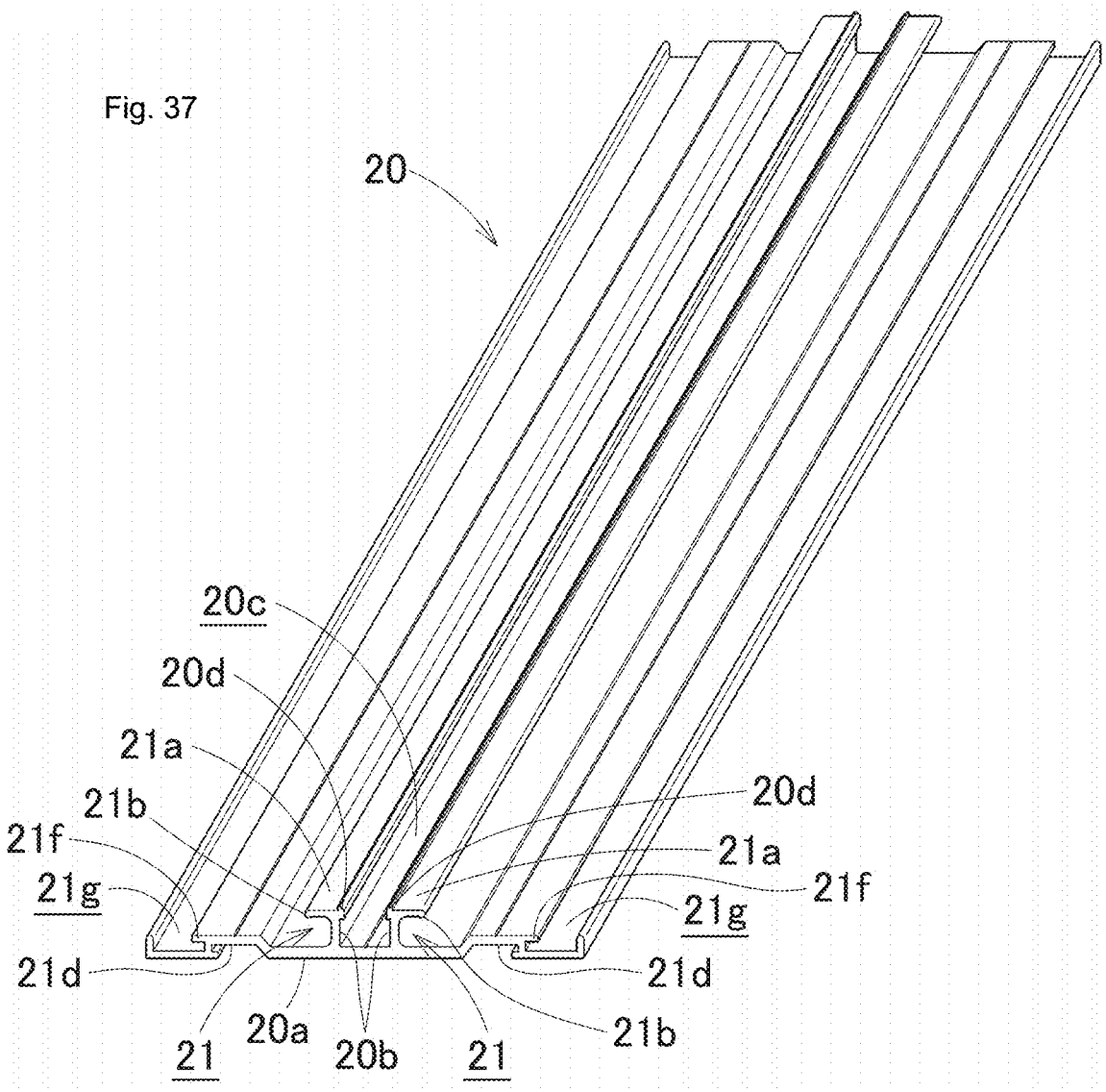
FIG. 37 is a perspective view of the furring strip base frame of the triangular panel fixed to the wall surface.
Figure 38:
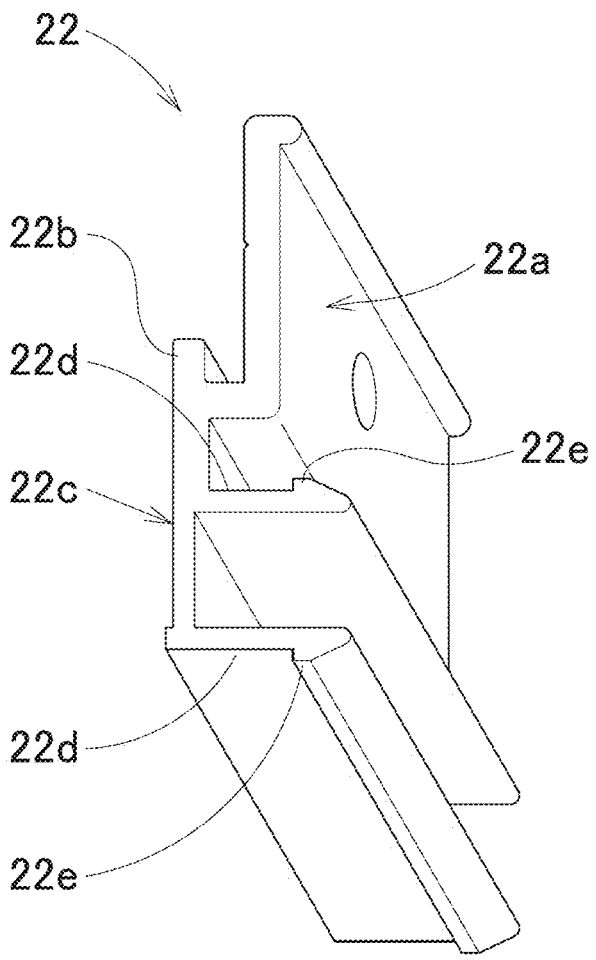
FIG. 38 is a perspective view of a fitting receiver attached to the furring strip base frame of the quadrilateral panel so as to be swingable.

When the planar shape of the polygonal panel 1 is the regular triangle, the furring strip base frame 20 has a fixed surface portion 20*a* to be fixed to the mounting surface 2, such as the wall surface, as shown in FIGS. 23 and 37. The gasket fitting groove 20*c* is formed between the opposite surface portions 20*b*, 20*b* projecting from the central portion of the fixed surface portion 20*a*. In the fitting groove 21 of the furring strip base frame 20, the retaining ribs 20*d*, 20*d* are formed on the inner sides of side ends of the opposite surface portions 20*b*, 20*b*, and on the outer side, two flat portions 21*a*, 21*a* parallel to the fixed surface portion 20*a* project. The fitting groove 21 of the furring strip base frame 20 is formed to be surrounded by the flat portions 21*a*, 21*a*, the opposite surface portions 20*b*, 20*b*, and the fixed surface portion 20*a*. When the mounting surface 2 is deformed due to an earthquake, a strong wind, or the like, a first rib 11*d* of the fitting portion 11 of the polygonal panel 1 slides on the flat portion 21*a* including a retaining rib 21*b*, engaged with the first rib 11*d*, at the outer end, and an inclined rib 11*e* of the fitting portion 11 slides on the fixed surface portion 20*a*, whereby a second rib 11*f* of the fitting portion 11 is attachable to and detachable from the opposite surface portion 20*b*. In the furring strip base frame 20, the two flat portions 21*d*, 21*d* parallel to the fixed surface portion 20*a* are extended on both sides of the fixed surface portion 20*a*, the engagement projection 21*f* is provided on each of the outer ends of the flat portions 21*d*, 21*d*, and a drain groove 21*g* is formed on each of the outer sides of the flat portions 21*d*, 21*d*. The drain groove 21*g* is designed to efficiently drain rainwater or the like that enters between the polygonal panel 1 and the mounting surface 2 in rainy weather or the like. With respect to the fitting groove 21 of the furring strip base frame 20, as shown in FIGS. 22 and 25, the insertion portion 22*a* of the fitting receiver 22 to be described later is inserted into the corner 1*b* of the polygonal panel 1. The insertion portion 22*a* is pivotally supported by a rivet or the like on the flat portion 21*d*, and hence the fitting receiver 22 is attached to the furring strip base frame 20 so as to be swingable. Further, the engagement projection 21*f* of the furring strip base frame 20 is engaged in a slidable manner with the engagement projection 22*b* of the fitting receiver 22 to be described later. In this way, the fitting receiver 22 can be swung without shaking, and when a separating force acts between the fitting receiver 22 and the furring strip base frame 20, the fitting receiver 22 and the furring strip base frame 20 are prevented from being separated by the separating force.

As shown in FIGS. 6, 7, 12, and 38, when the planar shape of the polygonal panel 1 is the regular quadrilateral, the fitting receiver 22 has the insertion portion 22*a* to be inserted into the fitting groove 21*e* of the furring strip base frame 20. The engagement projection 22*b* to be engaged with the engagement projection 21*f* of the furring strip base frame 20 is provided at the base end of the insertion portion 22*a*. Further, the insertion portion 22*a* is continuously connected to the fitting surface portion 22*c* that is fitted between the opposite surface portions 12*b*, 12*b* of the fitting cap 12. The fitting surface portion 22*c* has opposing surfaces 22*d*, 22*d* projecting parallel to each other so as to be fitted between the opposing surfaces 12*b*, 12*b* of the fitting cap 12, and on the outer sides of the outer ends of the opposing surfaces 22*d*, 22*d*, retaining ribs 22*e*, 22*e* caught on the retaining ribs 12*c*, 12*c* of the fitting cap 12 are formed, respectively.

Figure 39:
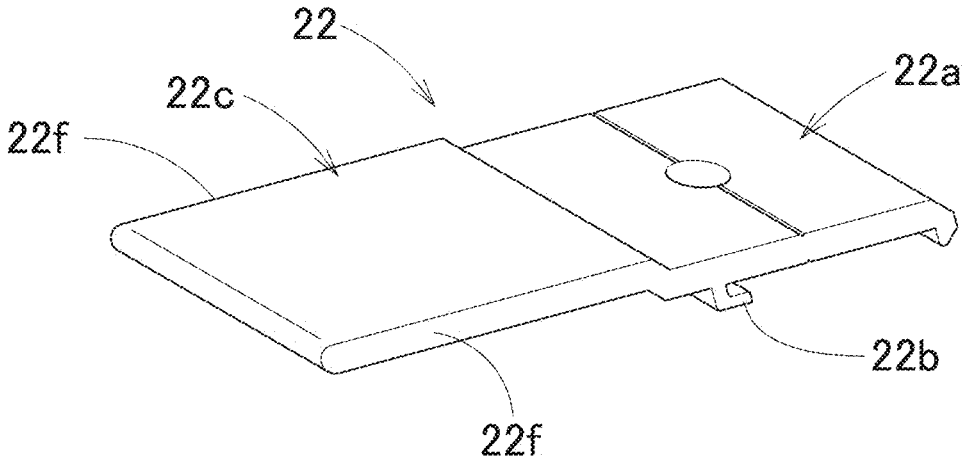
FIG. 39 is a perspective view of a fitting receiver attached to the furring strip base frame of the triangular panel so as to be swingable.

When the planar shape of the polygonal panel 1 is the regular triangle, the fitting receiver 22 has the insertion portion 22*a* to be inserted into the fitting groove 21 of the furring strip base frame 20, as shown in FIGS. 22, 25, and 39. The engagement projection 22*b* to be engaged with the engagement projection 21*f* of the furring strip base frame 20 is provided at the base end of the insertion portion 22*a*. Further, the insertion portion 22*a* is continuously connected to the fitting surface portion 22*c* that is fitted between the opposite surface portions 12*b*, 12*b* of the fitting cap 12. The fitting surface portion 22*c* is a flat portion designed to be fitted between the opposing surfaces 12*b*, 12*b* of the fitting cap 12, and the retaining ribs 12*c*, 12*c* of the fitting cap 12 are caught on the opposite sides 22*f*, 22*f* of the fitting surface portion 22*c*.

Figure 40:
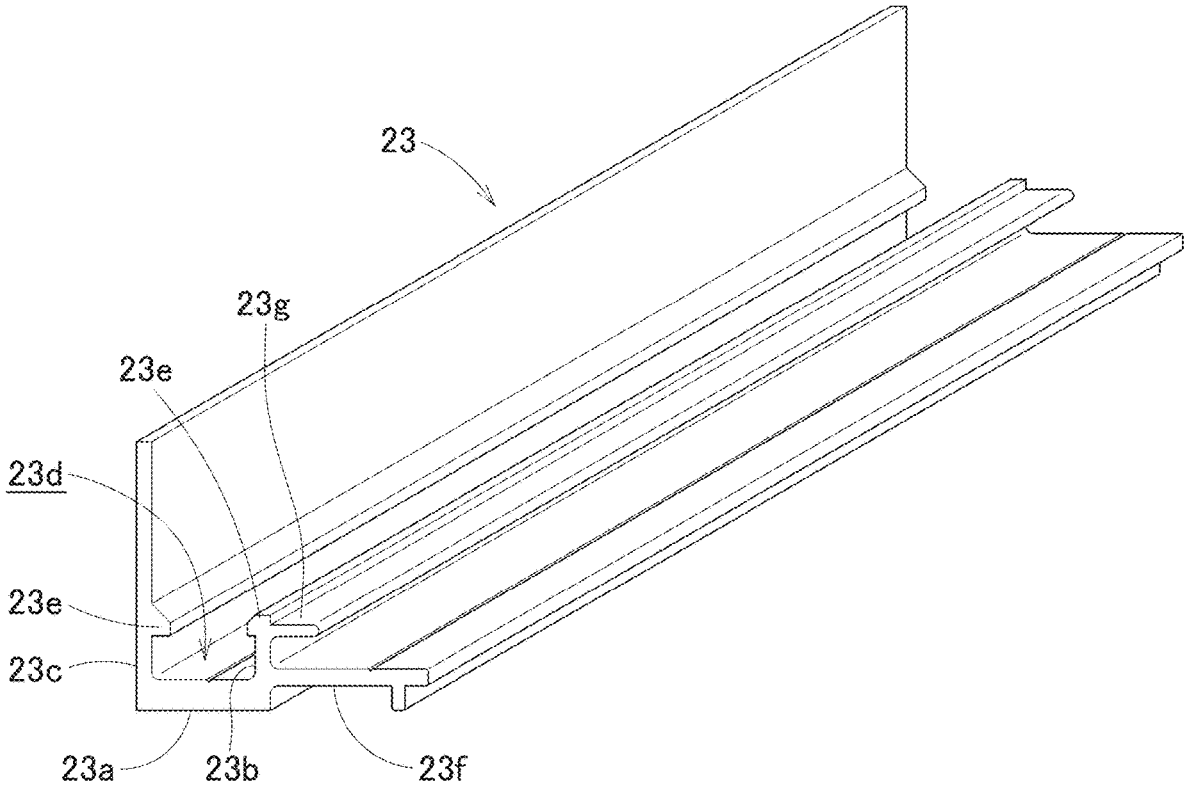
FIG. 40 is a perspective view of the one-side-end base frame of the quadrilateral panel fixed to the wall surface.

In the one-side-end base frame 23, when the planar shape of the polygonal panel 1 is the regular quadrilateral, as shown in FIGS. 15 and 40, the space between opposite surface portions 23*b*, 23*c* projecting from a fixed surface portion 23*a* to be fixed to the mounting surface 2, such as the wall surface, is formed as a gasket fitting groove 23*d*, and retaining ribs 23*e*, 23*e* of the gasket 15 are formed on the inner sides of opposite surface portions 23*b*, 23*c*. Two flat portions 23*f*, 23*g* parallel to the fixed surface portion 23*a* project on the outer side of the opposite surface portion 23*b*, and as shown in FIG. 15, the rib 13*c* of the abutting frame 13 abuts against the flat portion 23*g*.

Figure 41:
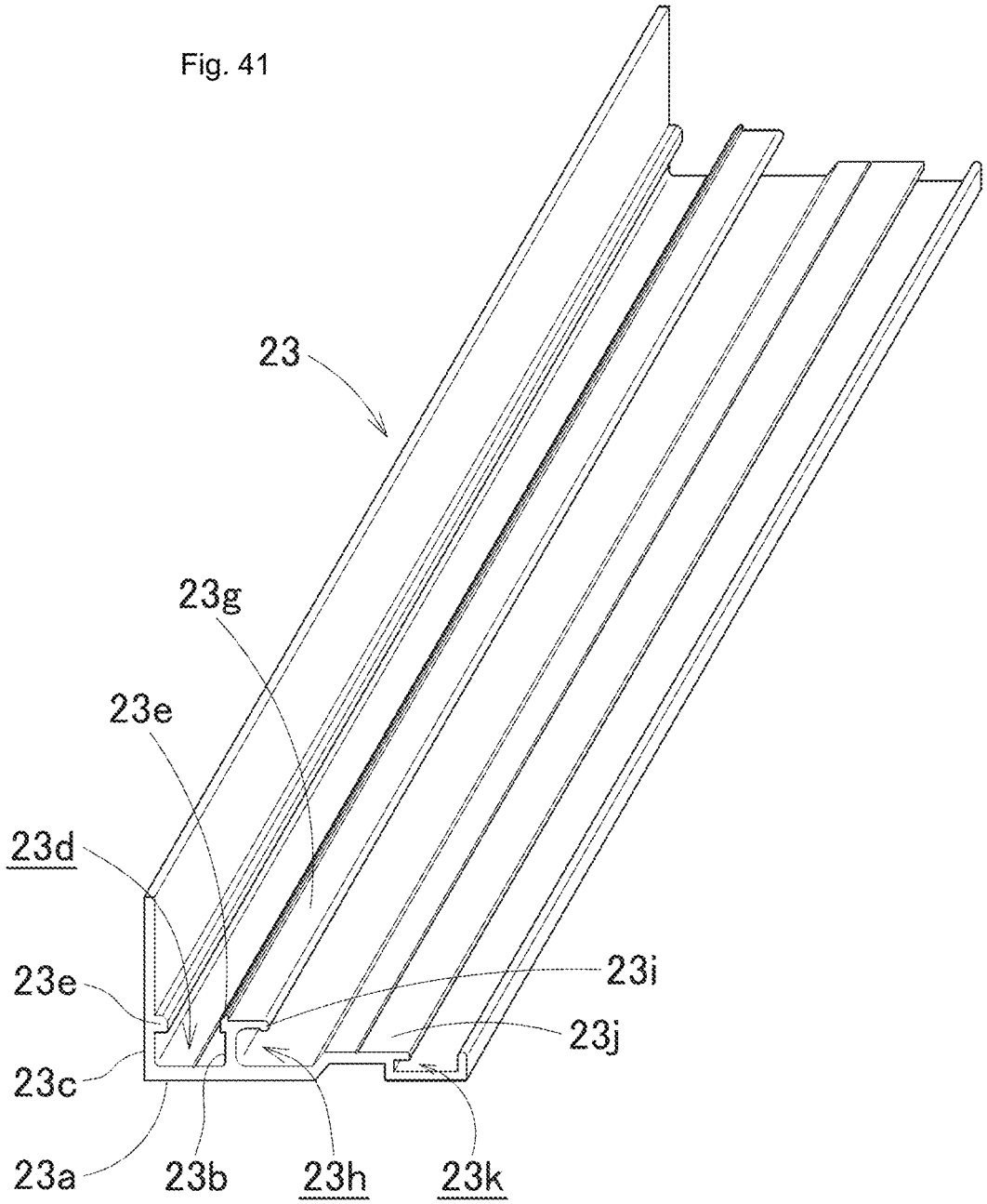
FIG. 41 is a perspective view of the one-side-end base frame of the triangular panel fixed to the wall surface.

In the one-side-end base frame 23, when the planar shape of the polygonal panel 1 is the regular triangle, as shown in FIGS. 26 and 41, the space between the opposite surface portions 23*b*, 23*c* projecting from the fixed surface portion 23*a* to be fixed to the mounting surface 2, such as the wall surface, is formed as the gasket fitting groove 23*d*, the retaining ribs 23*e*, 23*e* of the gasket 15 are formed on the inner sides of opposite surface portions 23*b*, 23*c*, and the flat portion 23*g* parallel to the fixed surface portion 23*a* projects on the outer side of the opposite surface portion 23*b*. In the fitting groove 23*h* surrounded by the flat portion 23*g*, the fixed surface portion 23*a*, and the opposite surface portion 23*b*, as shown in FIG. 26, when the mounting surface 2 is deformed due to an earthquake, a strong wind, or the like, the first rib 11*d* of the fitting portion 11 of the polygonal panel 1 slides on the flat portion 23*g* including a retaining rib 23*i* engaged with the first rib 11*d* at the outer end, and the inclined rib 11*e* of the fitting portion 11 slides on the fixed surface portion 23*a*, whereby the second rib 11*f* of the fitting portion 11 is attachable to and detachable from the opposite surface portion 23*b*. In the one-side-end base frame 23, a flat portion 23*j* parallel to the fixed surface portion 23*a* is extended on the outer side of the fixed surface portion 23*a*, and a drain groove 23*k* is formed on the outer side of the flat portion 23*j*. The drain groove 23*k* is designed to efficiently drain rainwater or the like that enters between the polygonal panel 1 and the mounting surface 2 in rainy weather or the like.

Figure 42:
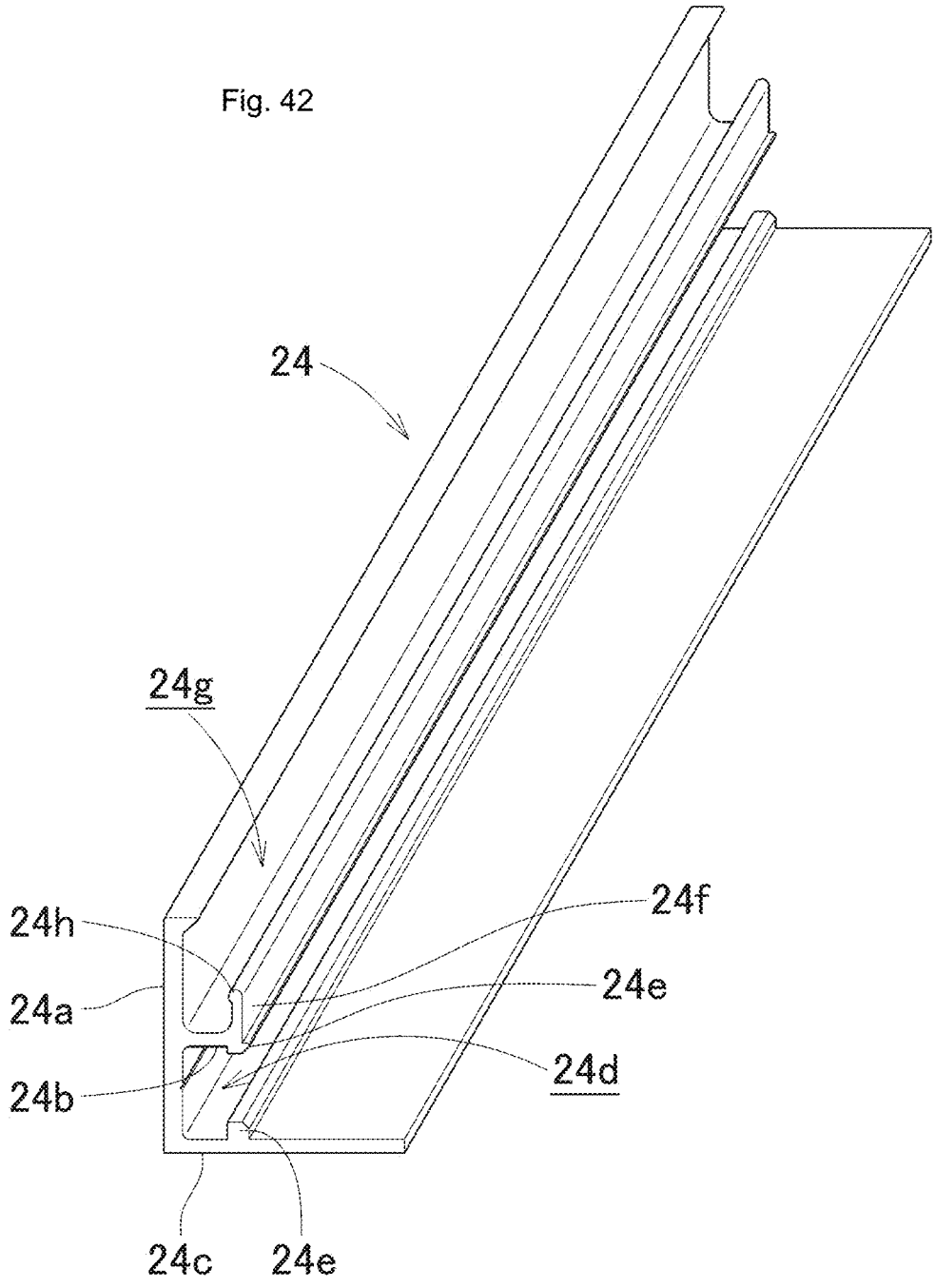
FIG. 42 is a perspective view of the other-side-end base frame of the quadrilateral panel fixed to the wall surface.

The other-side-end base frame 24 is used when the planar shape of the polygonal panel 1 is the regular quadrilateral. As shown in FIGS. 13 and 42, the space between opposite surface portions 24*b*, 24*c* projecting from a fixed surface portion 24*a* to be fixed to the mounting surface 2, such as the wall surface, is formed as a gasket fitting groove 24*d*, retaining ribs 24*e*, 24*e* of the gasket 15 are formed on the inner sides of opposite surface portions 24*b*, 24*c*, and a flat portion 24*f* parallel to the fixed surface portion 24*a* projects from the outer end of the opposite surface portion 24*b*. In the fitting groove 24*g* surrounded by the flat portion 24*f*, the fixed surface portion 24*a*, and the opposite surface portion 24*b*, when the mounting surface 2 is deformed due to an earthquake, a strong wind, or the like, the first rib 11*d* of the fitting portion 11 of the polygonal panel 1 slides on the flat portion 24*f* including a retaining rib 24*h* engaged with the first rib 11*d* at the outer end, and the inclined rib 11*e* of the fitting portion 11 slides on the fixed surface portion 24*a*, whereby the second rib 11*f* of the fitting portion 11 is attachable to and detachable from the opposite surface portion 24*b*.

In the implementation of the polygonal panel mounting structure according to the present invention, the procedure for mounting the polygonal panel 1 on the mounting surface 2, such as the wall surface, will be described as follows.

Figure 43:
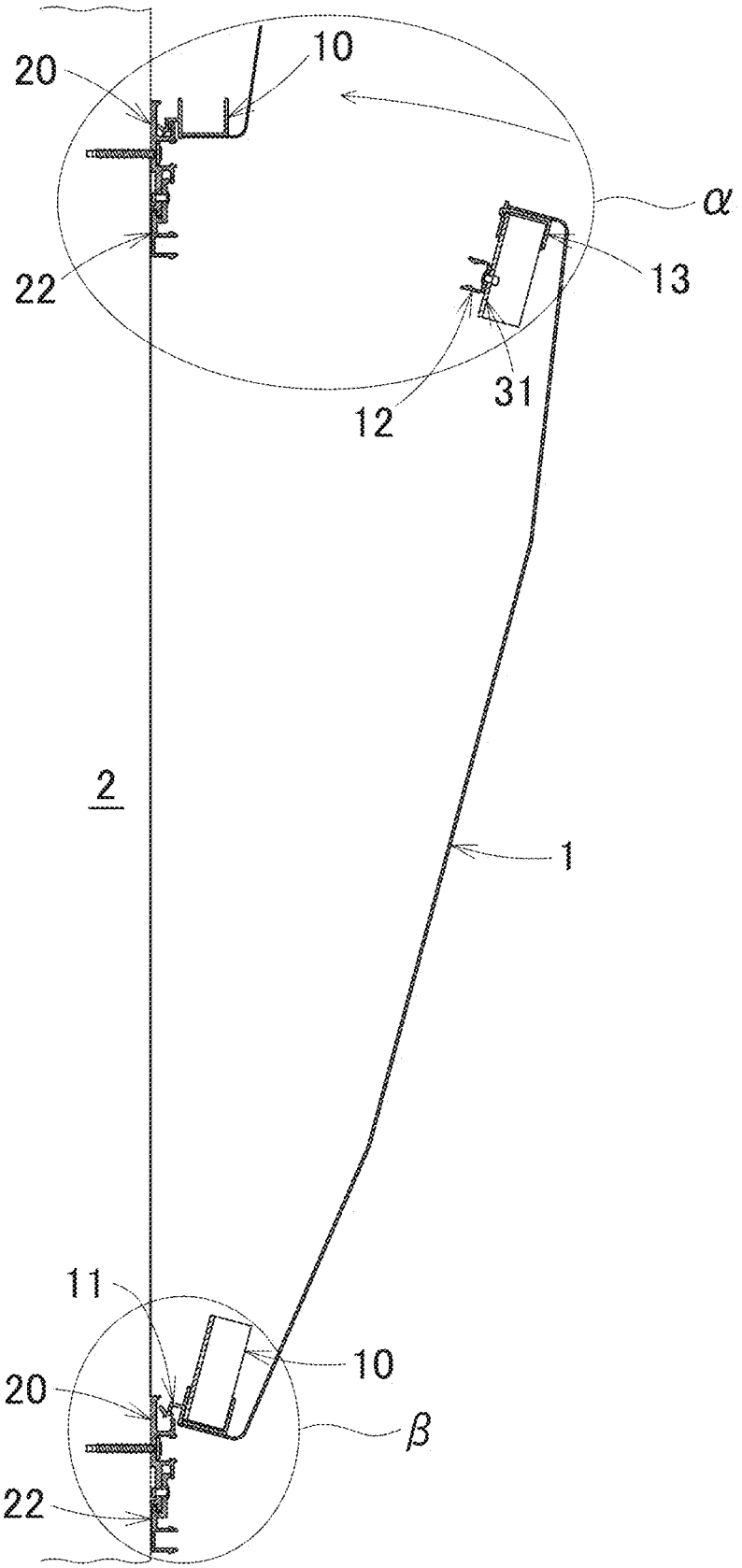
FIG. 43 is an explanatory view showing a procedure for mounting one of the quadrilateral panels to a wall surface in the polygonal panel mounting structure of the present invention.
Figure 44:
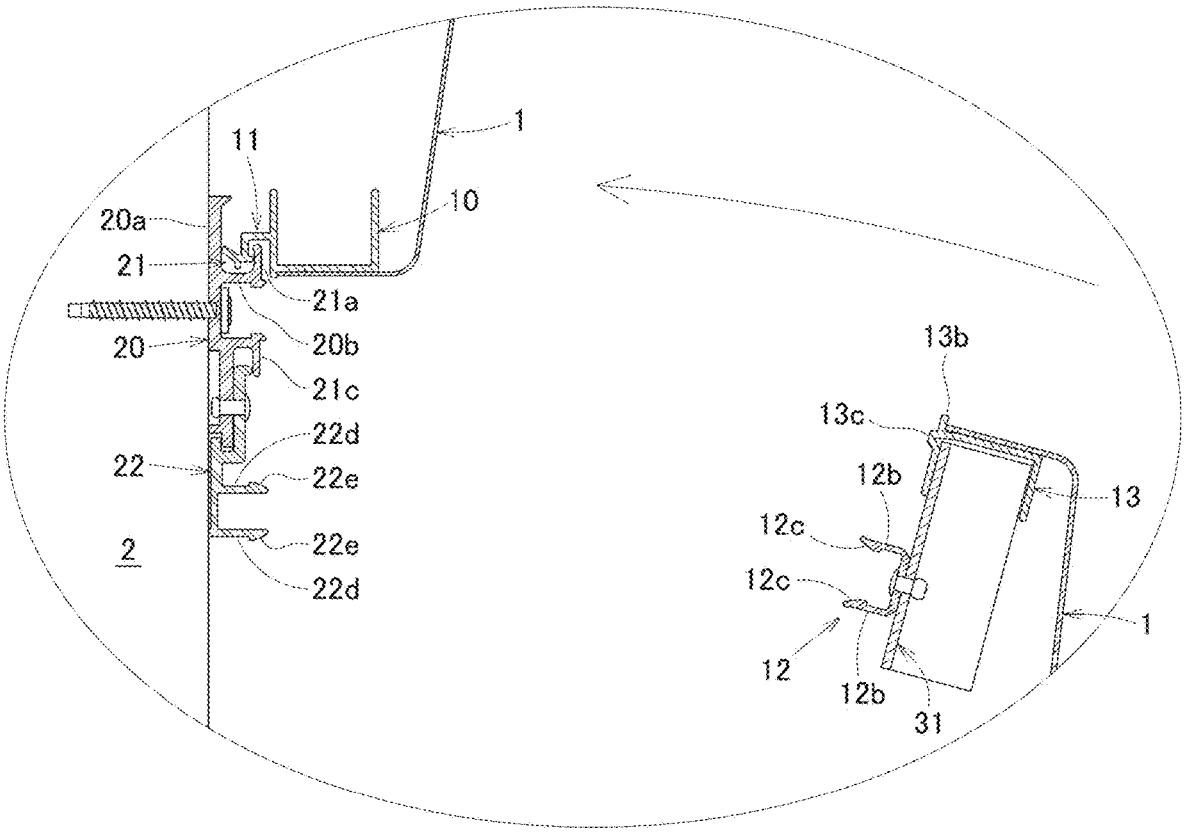
FIG. 44 is an enlarged view of a portion α surrounded by a circle in FIG. 43.
Figure 45:
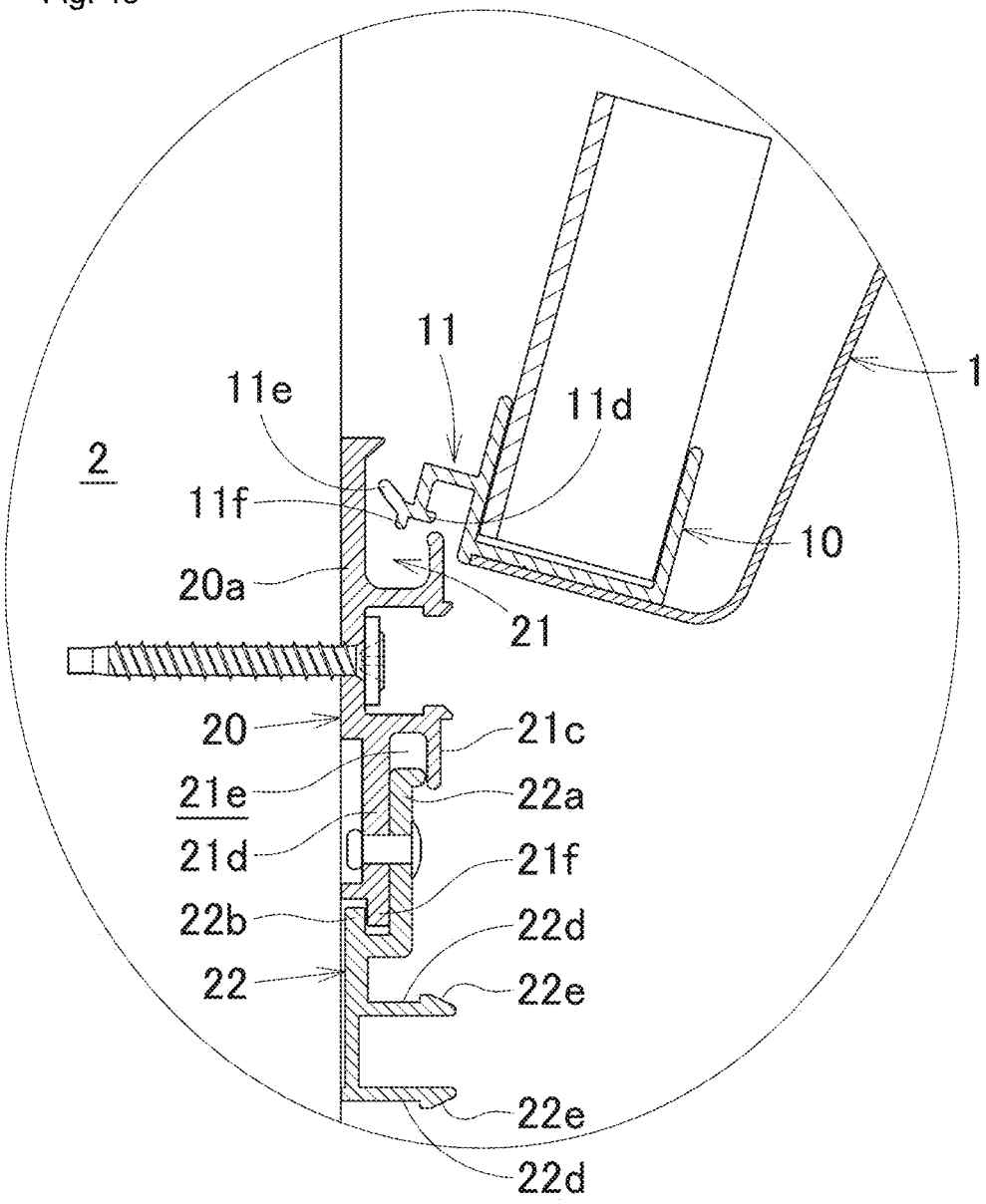
FIG. 45 is an enlarged view of a portion β surrounded by a circle in FIG. 43.

First, when the planar shape of the polygonal panel 1 is the regular quadrilateral, as shown in FIGS. 43 to 45, the polygonal panel 1 is set obliquely to the vertical direction in the figure, and the fitting portion 11 is loosely inserted into the fitting groove 21, provided in one of the furring strip base frames 20 fixed parallel to each other on the mounting surface 2, obliquely from above so that the inclined rib 11*e* of the fitting portion 11 of the fitting frame 10 slides on the fixed surface portion 20*a* of the furring strip base frame 20.

Figure 46:
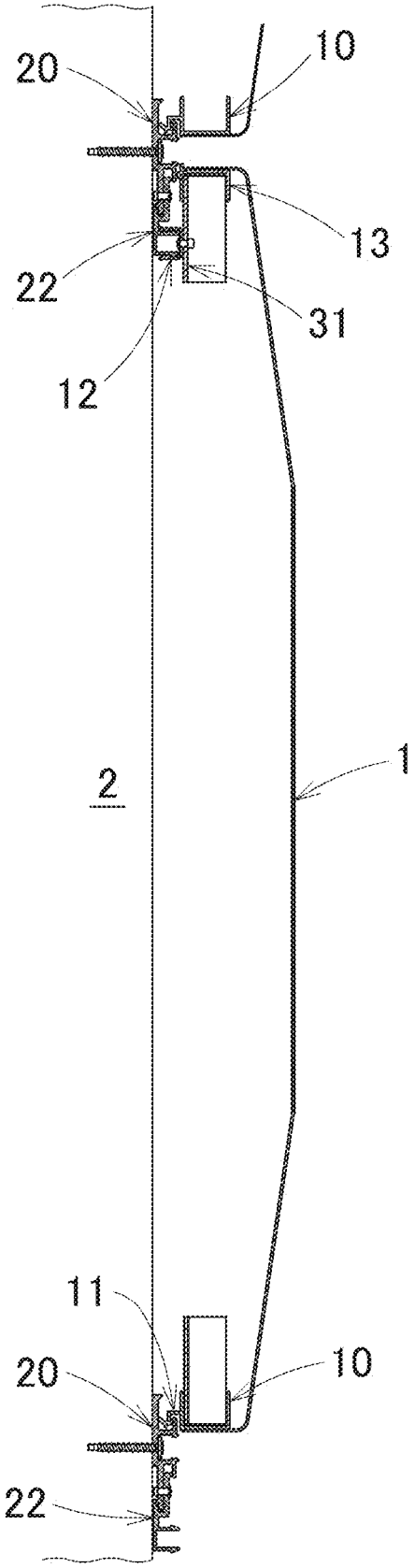
FIG. 46 is an explanatory view showing a state after the one of the quadrilateral panels has been mounted on the wall surface in the polygonal panel mounting structure according to the present invention.

The polygonal panel 1 is rotated in the direction of the mounting surface 2, the abutting frame 13 approaches the other of the furring strip base frames 20 that are fixed to the mounting surface 2, parallel to each other. As shown in FIG. 46, while the rib 13*c* of the abutting frame 13 abuts against the flat portion 21*c* of the furring strip base frame 20, the retaining ribs 12*c*, 12*c* of the fitting cap 12 are pressed against the retaining ribs 22*d*, 22*d* of the fitting receiver 22 that is provided on the furring strip base frame 20 so as to be swingable, whereby the fitting cap 12 is fitted into the fitting receiver 22 (cf. FIG. 6).

Figure 7:
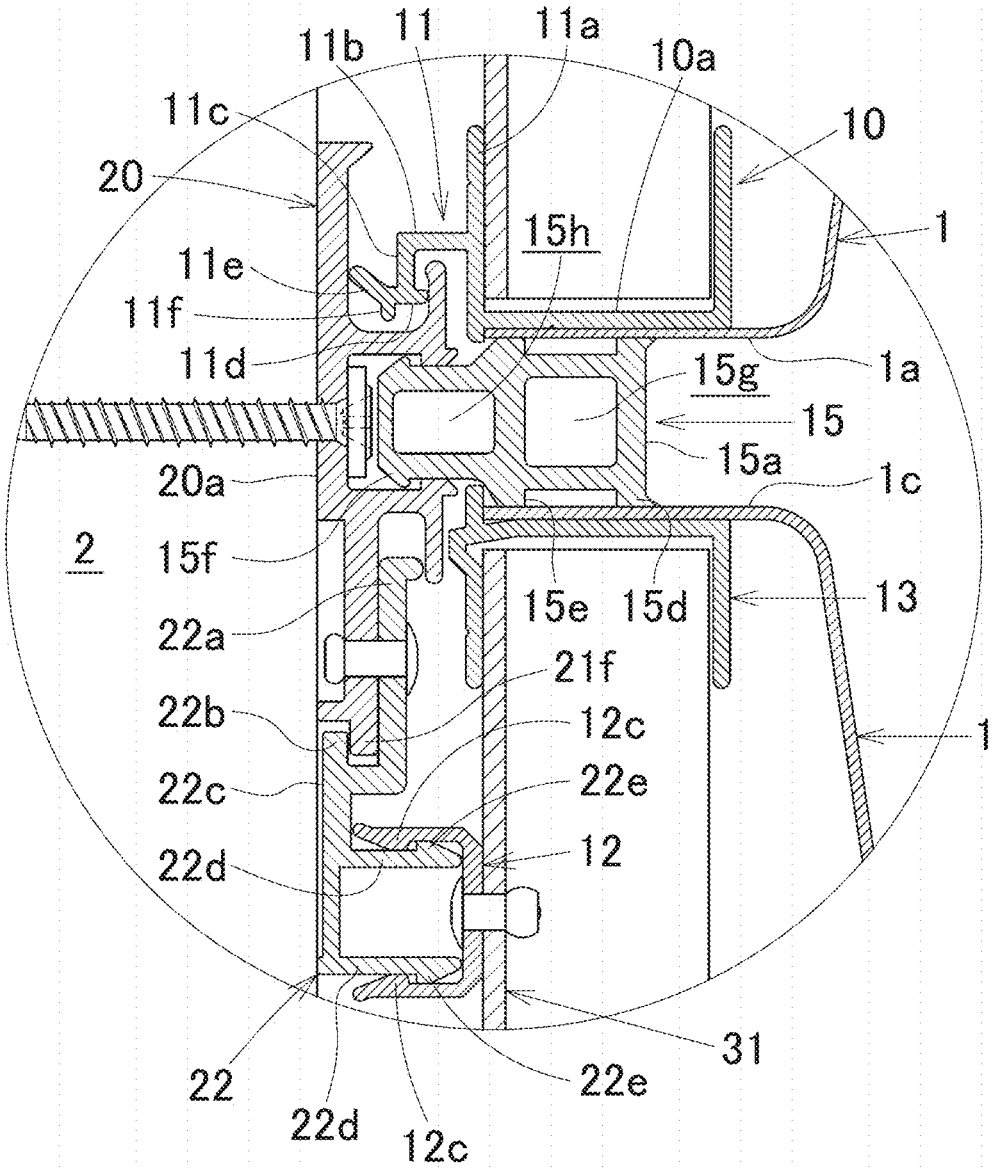
FIG. 7 is an enlarged view of a portion β surrounded by a circle in FIG. 5.
Figure 8:
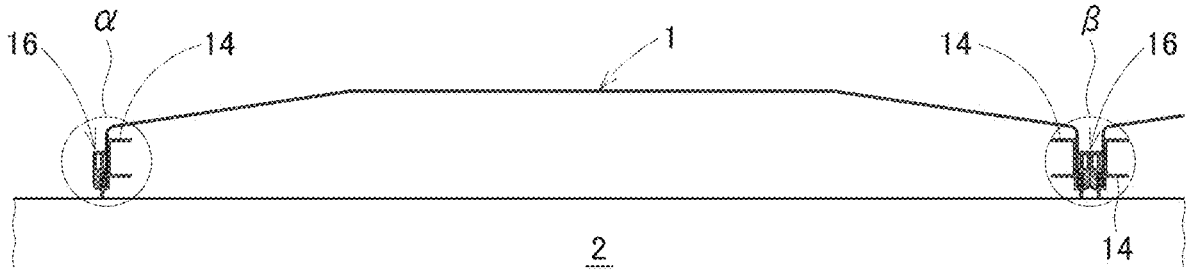
FIG. 8 is a cross-sectional view of the polygonal panel mounting structure according to the present invention, taken along line B-B in FIG. 1.
Figure 12:
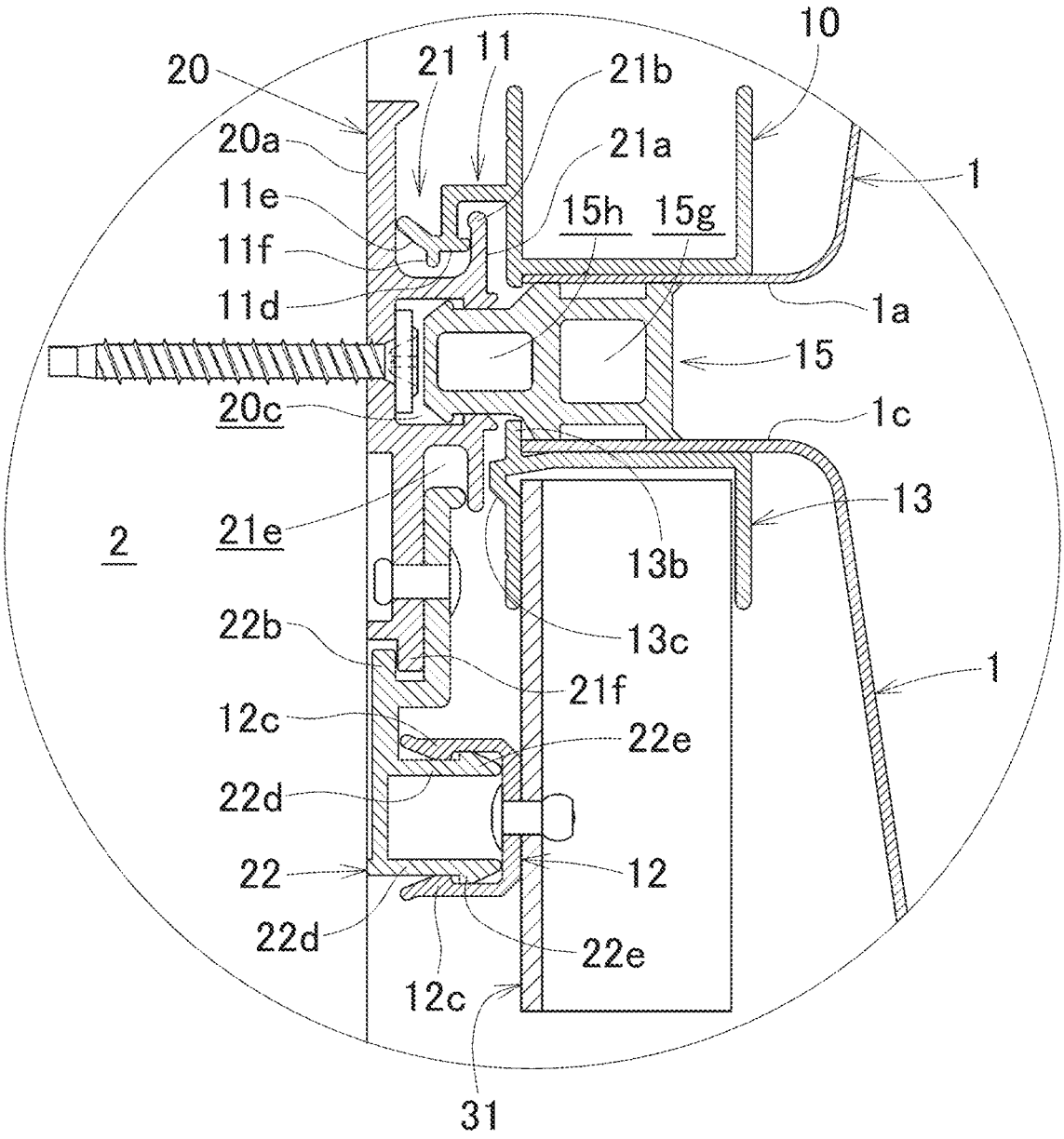
FIG. 12 is an enlarged view of a portion α surrounded by a circle in FIG. 11.

At the same time, the inclined rib 11*e* of the fitting portion 11 slides on the fixed surface portion 20*a* of the furring strip base frame 20, the first rib 11*d* slides on the flat portion 21*a* of the furring strip base frame 20, and the second rib 11*f* enter a state of being slightly separated from the opposite surface portion 20*b* of the furring strip base frame 20 (cf. FIGS. 7 and 12).

Figure 9:
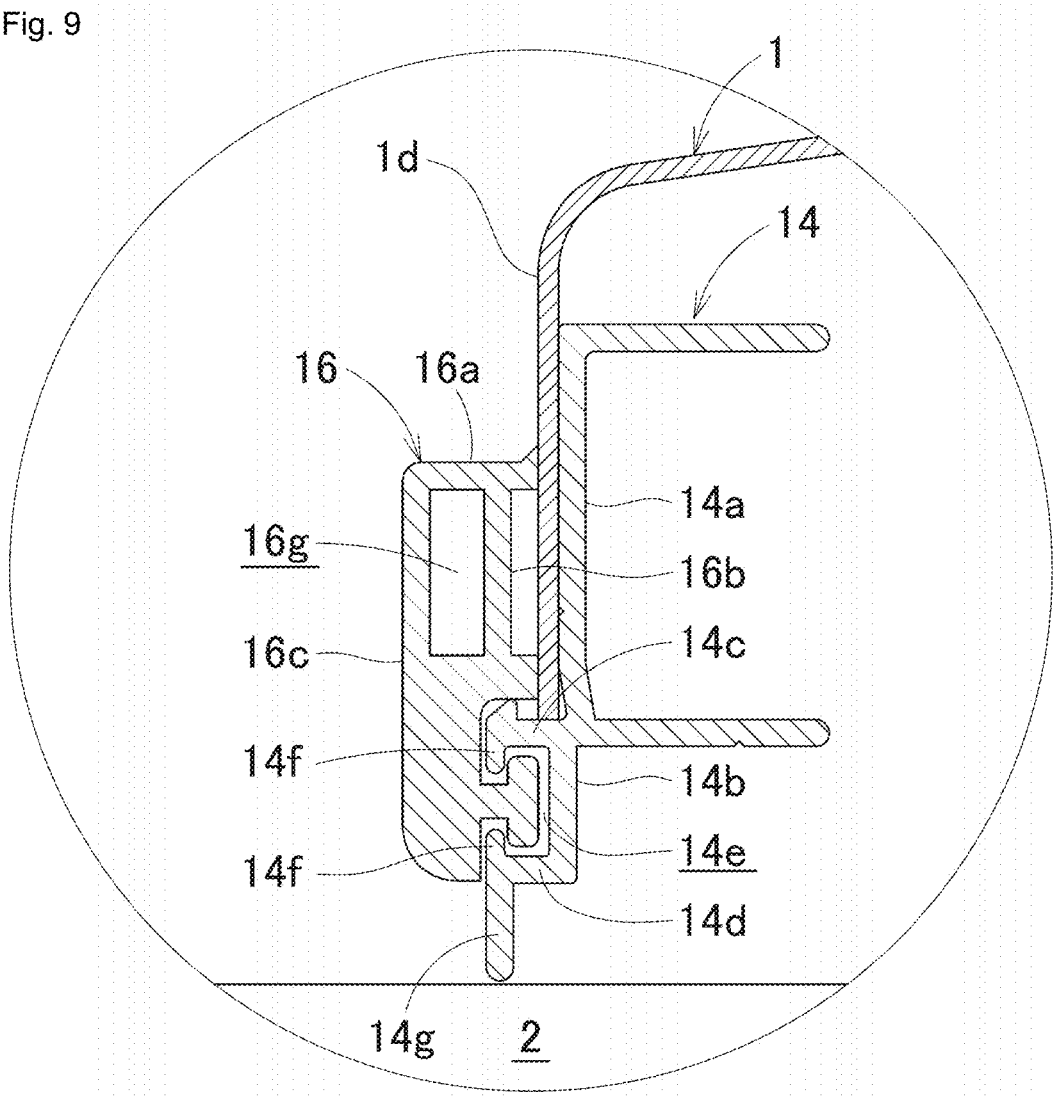
FIG. 9 is an enlarged view of a portion α surrounded by a circle in FIG. 8.
Figure 10:
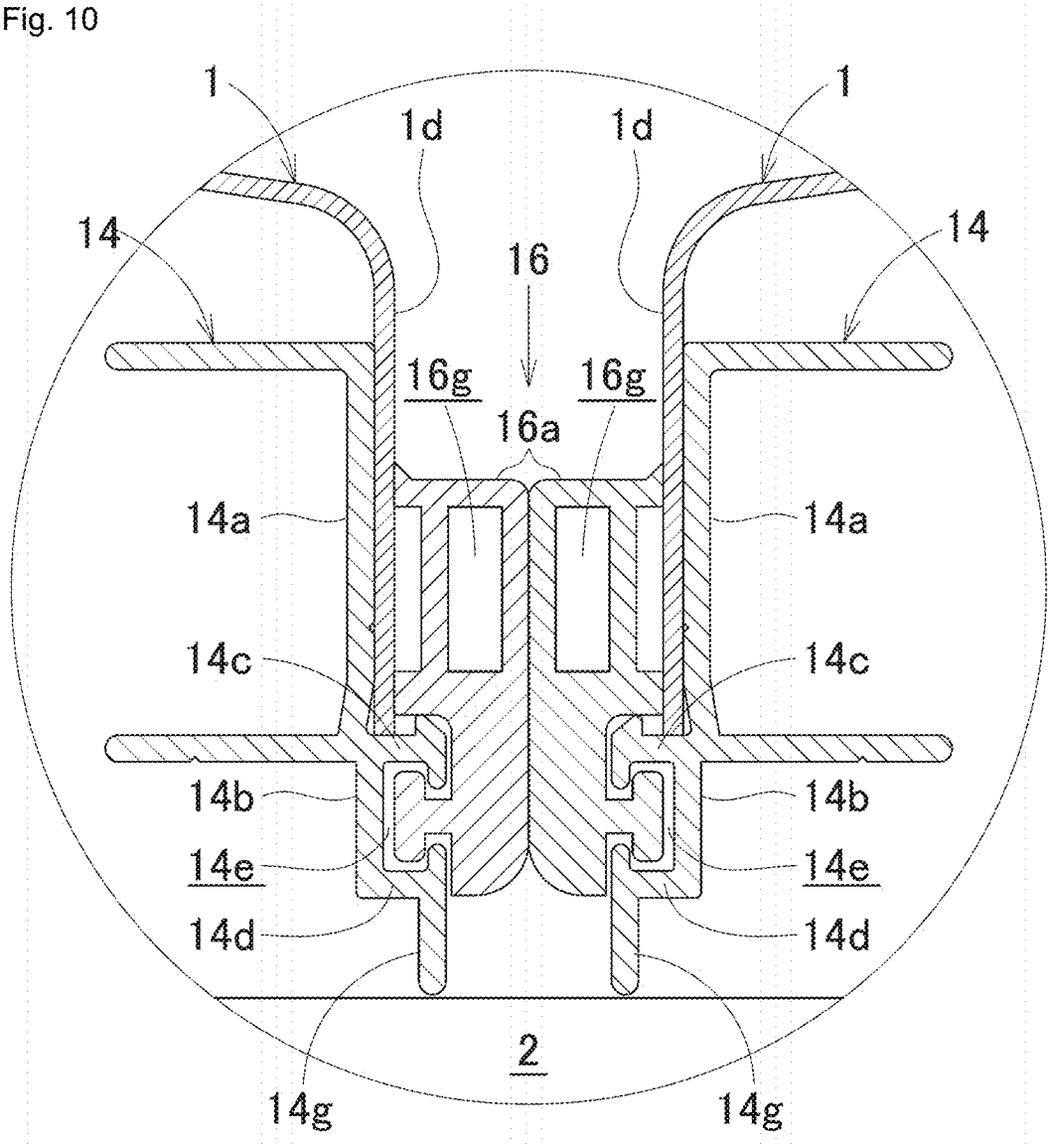
FIG. 10 is an enlarged view of a portion β surrounded by a circle in FIG. 8.

Further, the installation ribs 14*g*, 14*g* of the mating frames 14, 14 on the other side surfaces 1*d*, 1*d* of the polygonal panel 1 enter a state of being grounded to the mounting surface 2 (cf. FIGS. 9 and 10).

Figure 47:
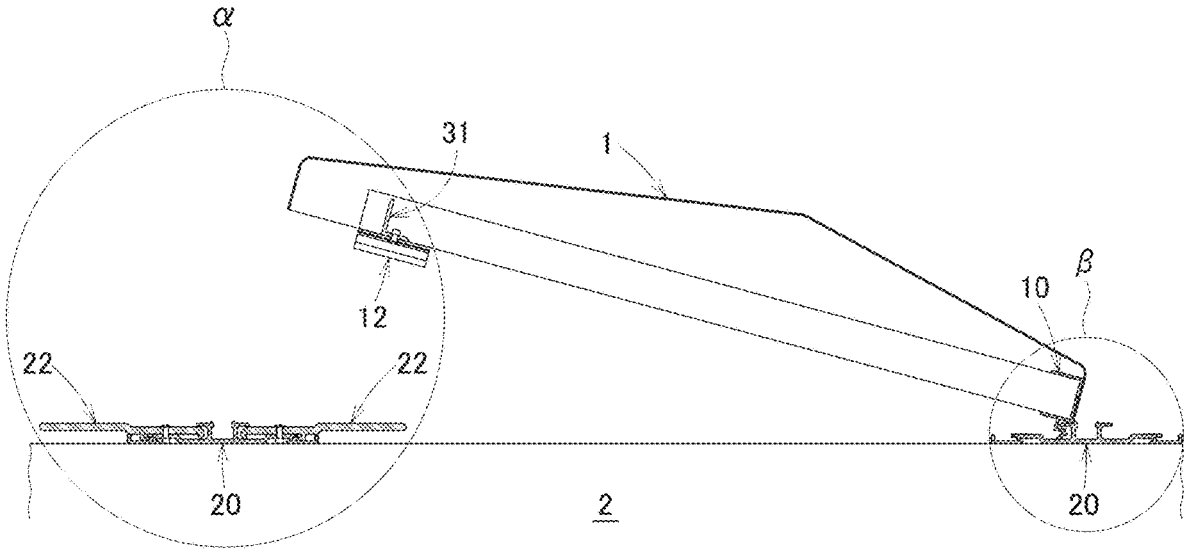
FIG. 47 is an explanatory view showing a procedure for mounting one of the triangular panels on a wall surface in the polygonal panel mounting structure of the present invention.
Figure 48:
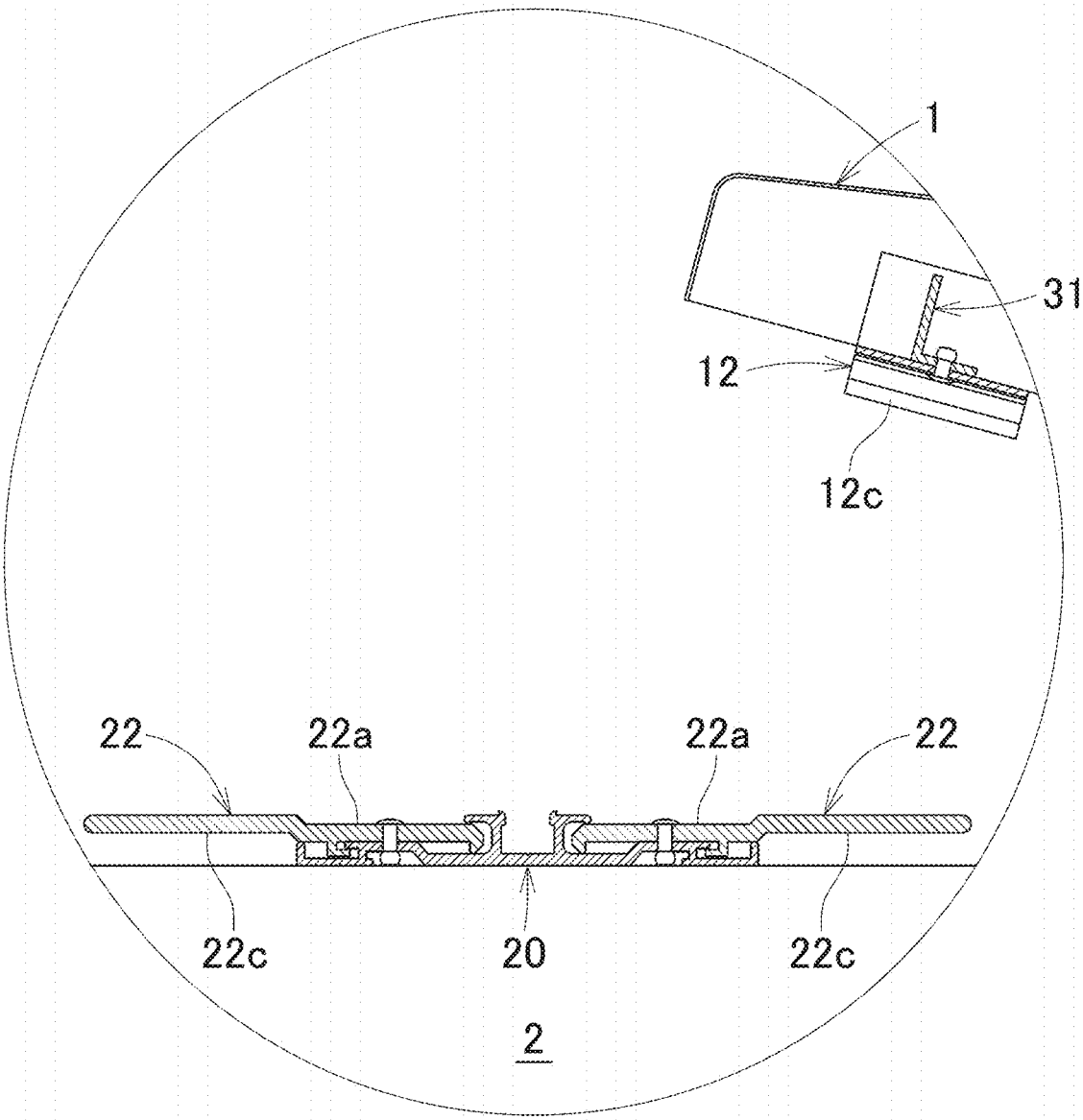
FIG. 48 is an enlarged view of a portion α surrounded by a circle in FIG. 47.
Figure 49:
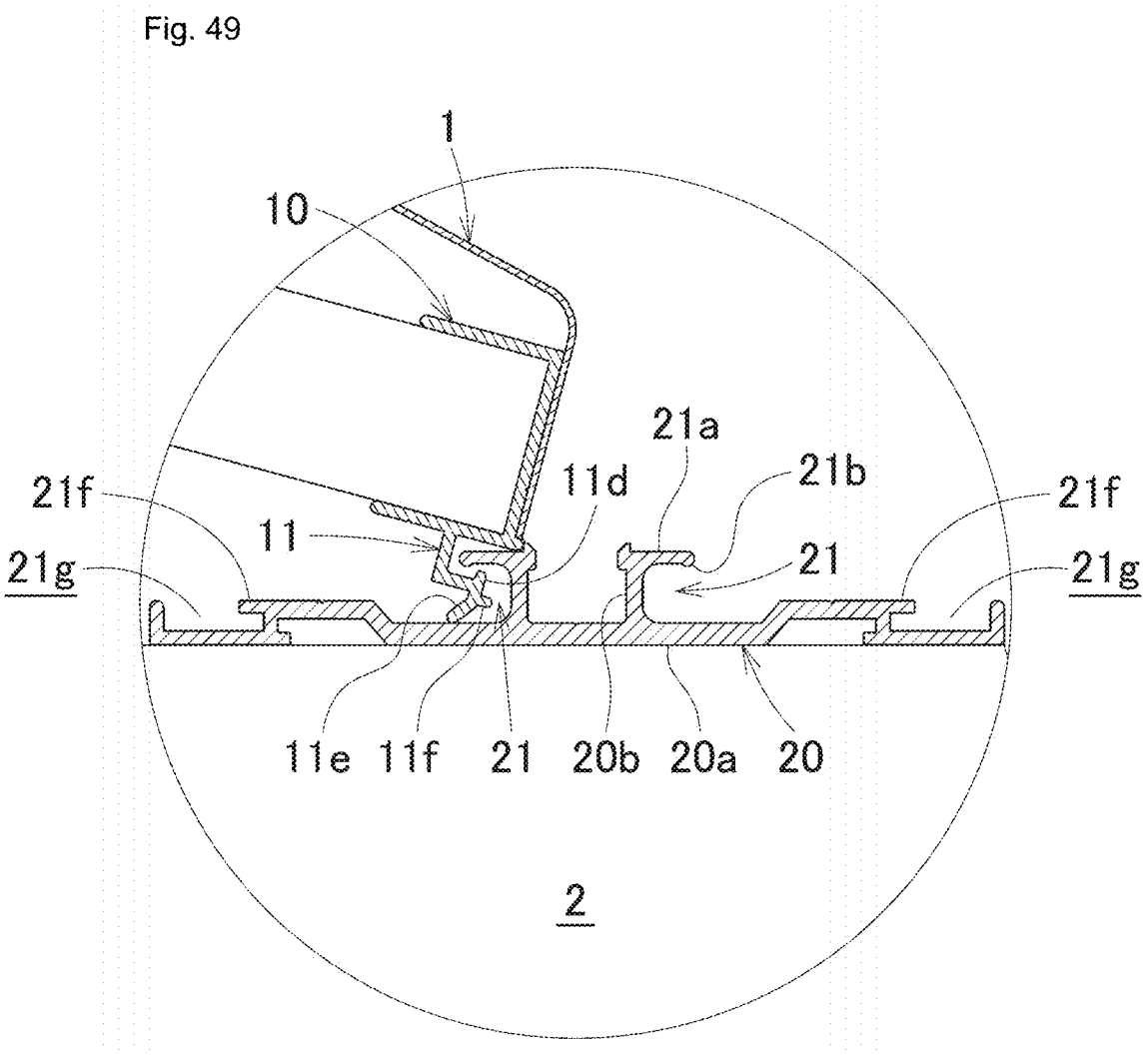
FIG. 49 is an enlarged view of a portion β surrounded by a circle in FIG. 47.

When the planar shape of the polygonal panel 1 is the regular triangle, as shown in FIGS. 47 to 49, the polygonal panel 1 is set obliquely to the left-right direction in the figure, and the fitting portion 11 of the fitting frame 10 is loosely inserted into the fitting groove 21, provided on one of the furring strip base frames 20 fixed perpendicularly to the mounting surface 2, obliquely from the side so that the inclined rib 11*e* of the fitting portion 11 slides on the fixed surface portion 20*a* of the furring strip base frame 20.

Figure 50:
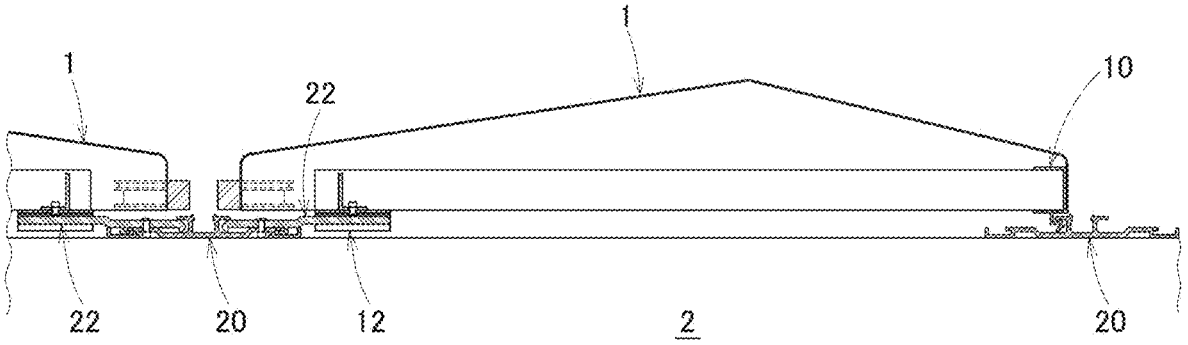
FIG. 50 is an explanatory view showing a state after the one of the triangular panels has been mounted on the wall surface in the polygonal panel mounting structure according to the present invention.

Then, the polygonal panel 1 is rotated in the direction of the mounting surface 2, the abutting frame 13 approaches the other of the furring strip base frames 20 fixed perpendicularly to the mounting surface 2. As shown in FIG. 50, the retaining ribs 12*c*, 12*c* of the fitting cap 12 are pressed against the side parts 22*e*, 22*e* of the fitting receiver 22 that is provided on the furring strip base frame 20 so as to be swingable, whereby the fitting cap 12 is fitted in the fitting receiver 22 (cf. FIGS. 22, 25).

At the same time, the inclined rib 11*e* of the fitting portion 11 slides on the fixed surface portion 20*a* of the furring strip base frame 20, the first rib 11*d* slides on the flat portion 21*a* of the furring strip base frame 20, and the second rib 11*f* enter a state of being slightly separated from the opposite surface portion 20*b* of the furring strip base frame 20 (cf. FIG. 23).

Figure 27:
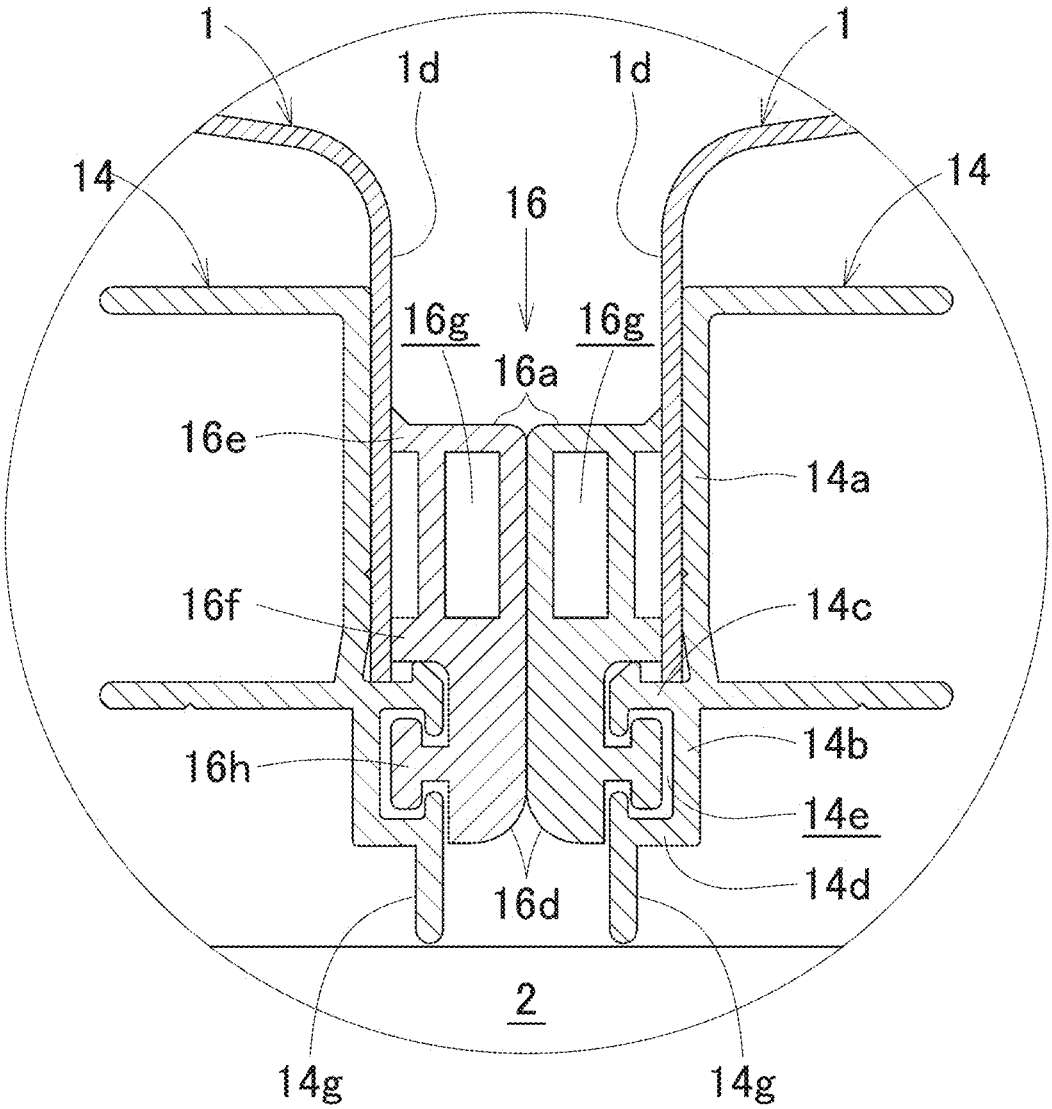
FIG. 27 is an enlarged cross-sectional view of the polygonal panel mounting structure according to the present invention, taken along line G-G in FIG. 17.
Figure 28:
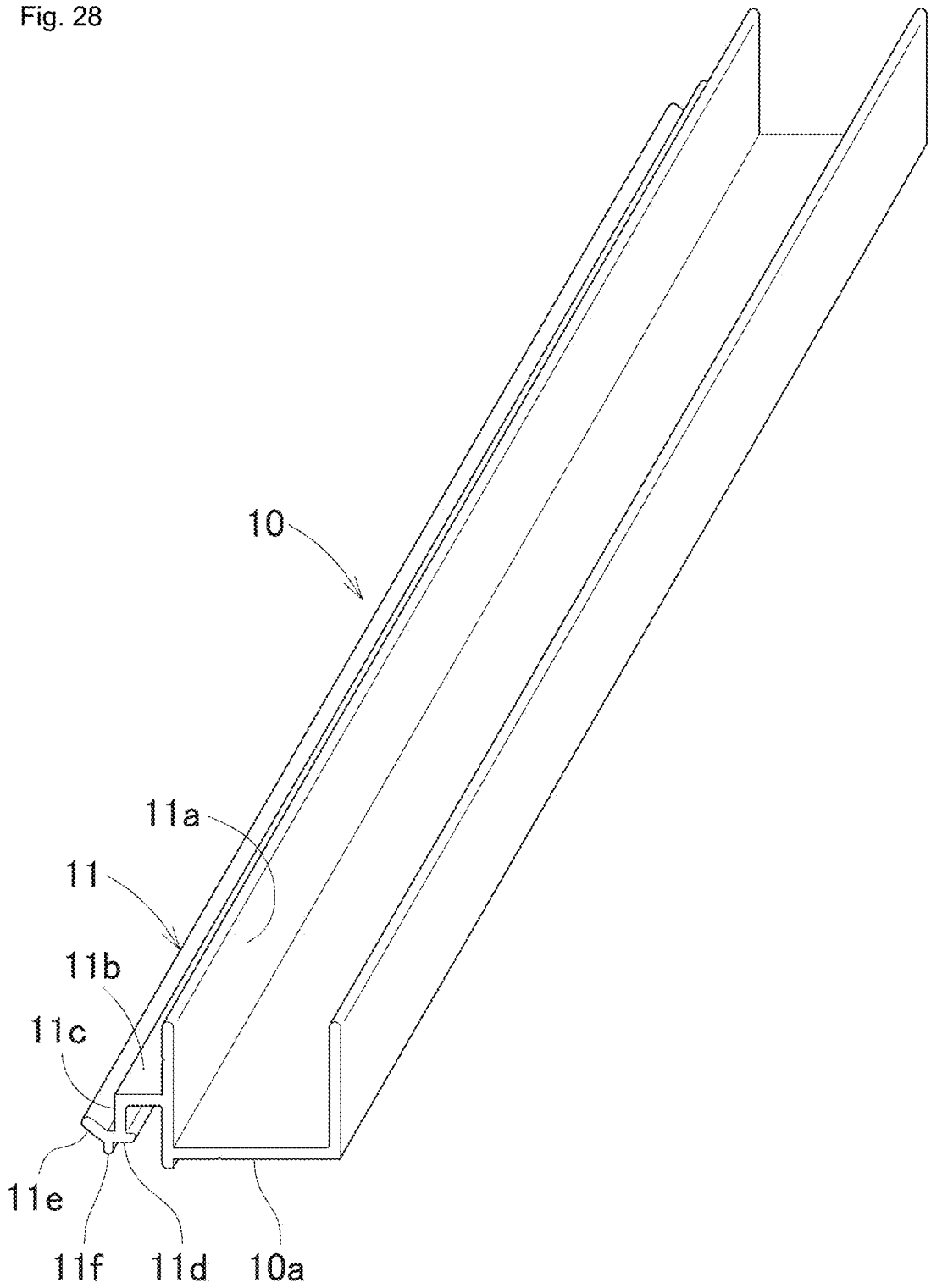
FIG. 28 is a view of a fitting frame of the quadrilateral panel and the triangular panel.
Figure 29:
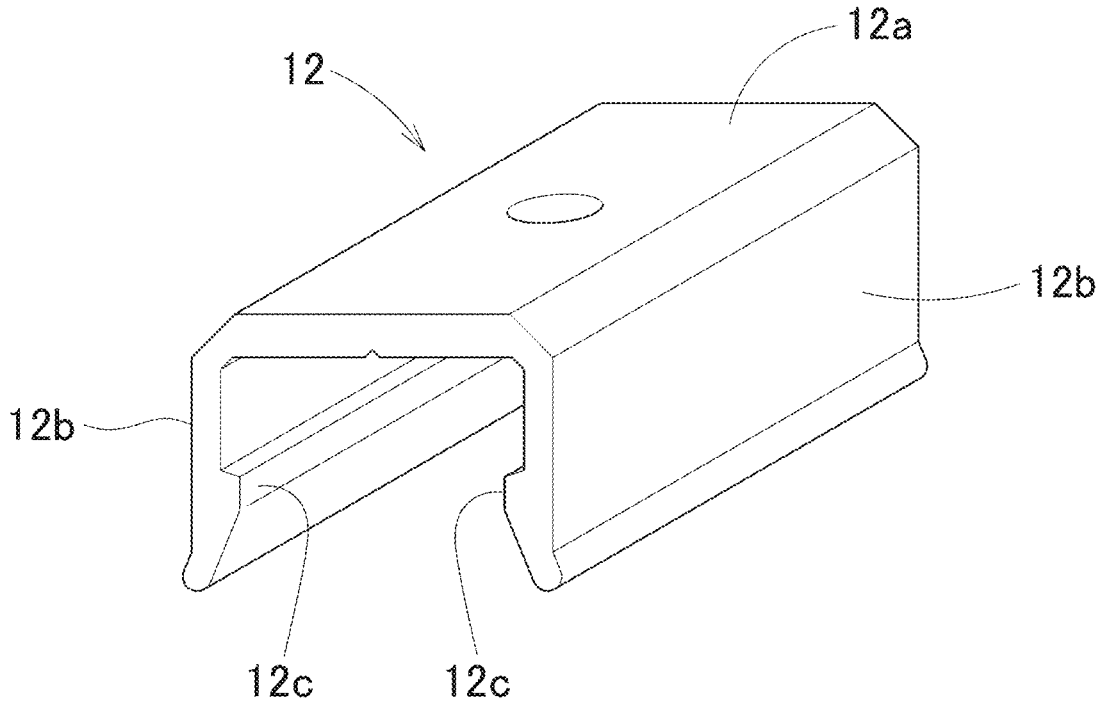
FIG. 29 is a perspective view of a fitting cap of the quadrilateral panel.
Figure 30:
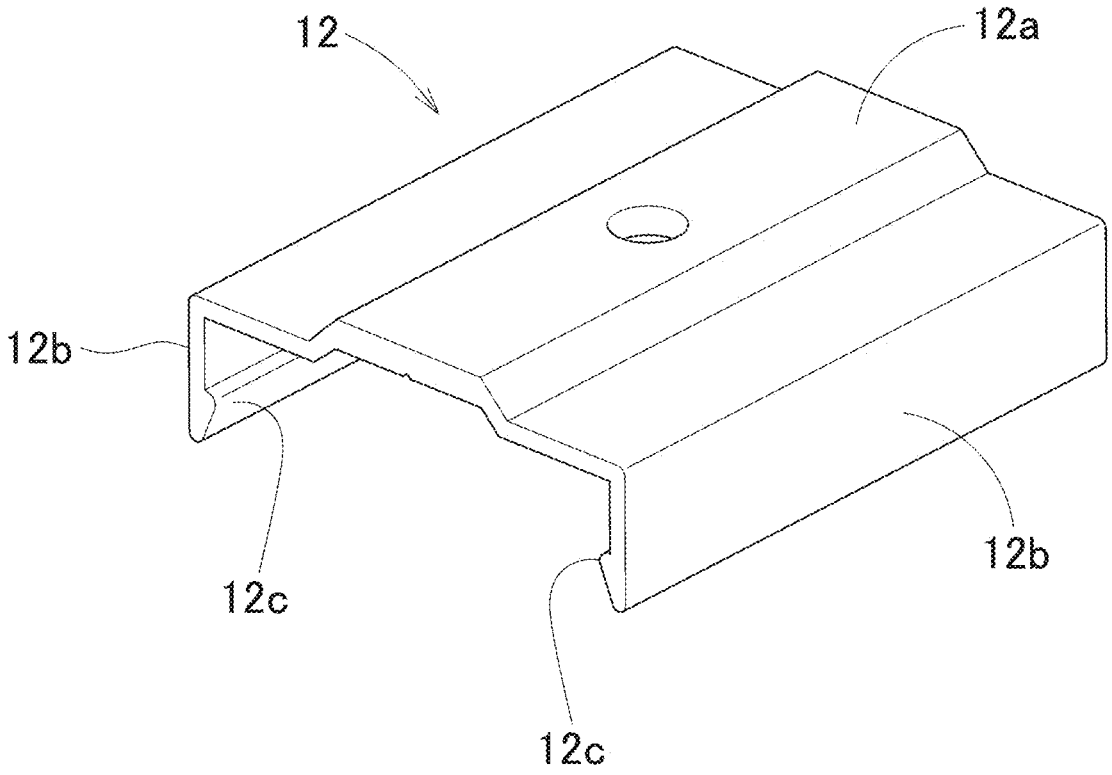
FIG. 30 is a perspective view of a fitting cap of the triangular panel.
Figure 31:
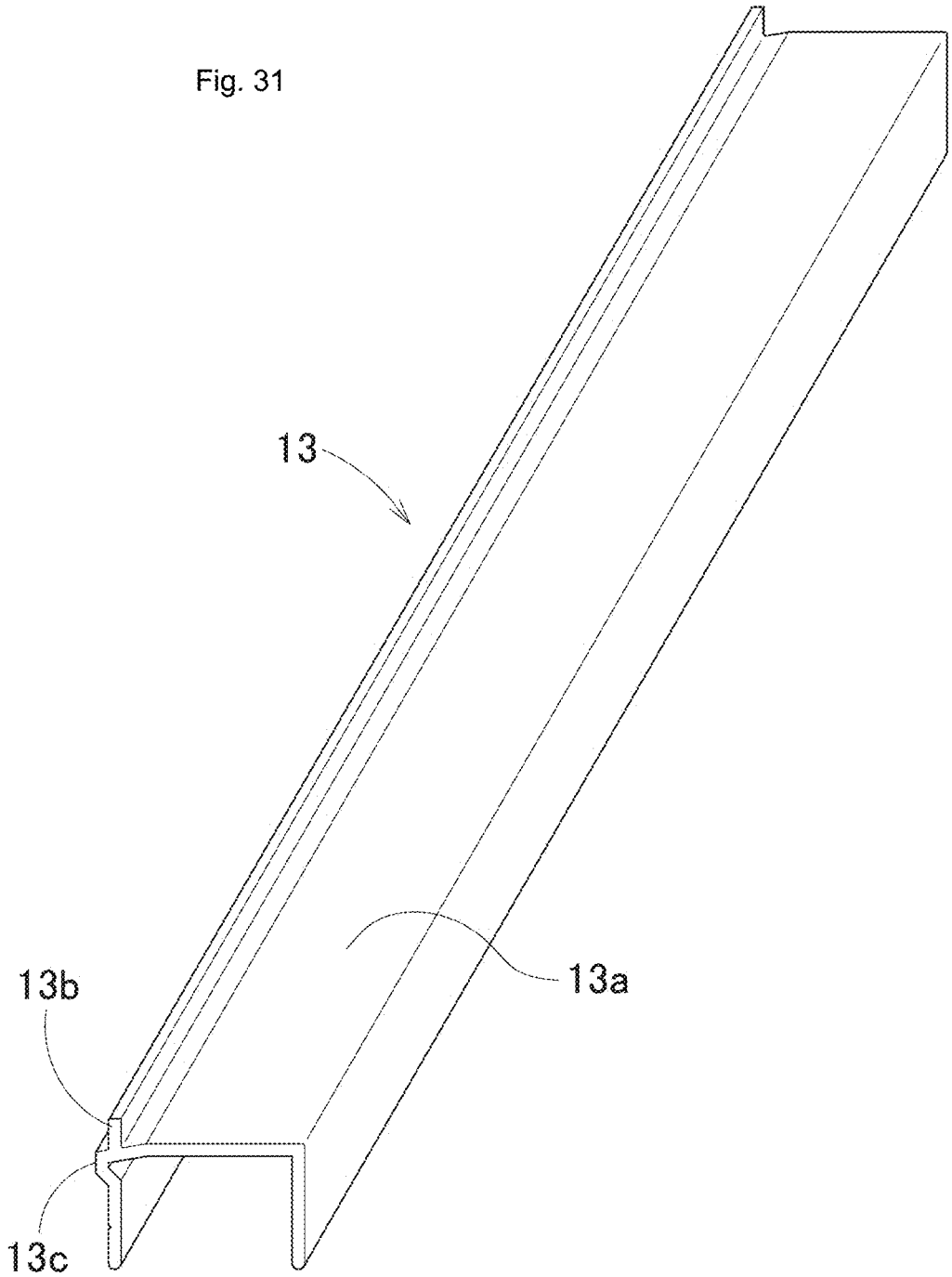
FIG. 31 is a perspective view of an abutting frame of the quadrilateral panel and the triangular panel.
Figure 32:
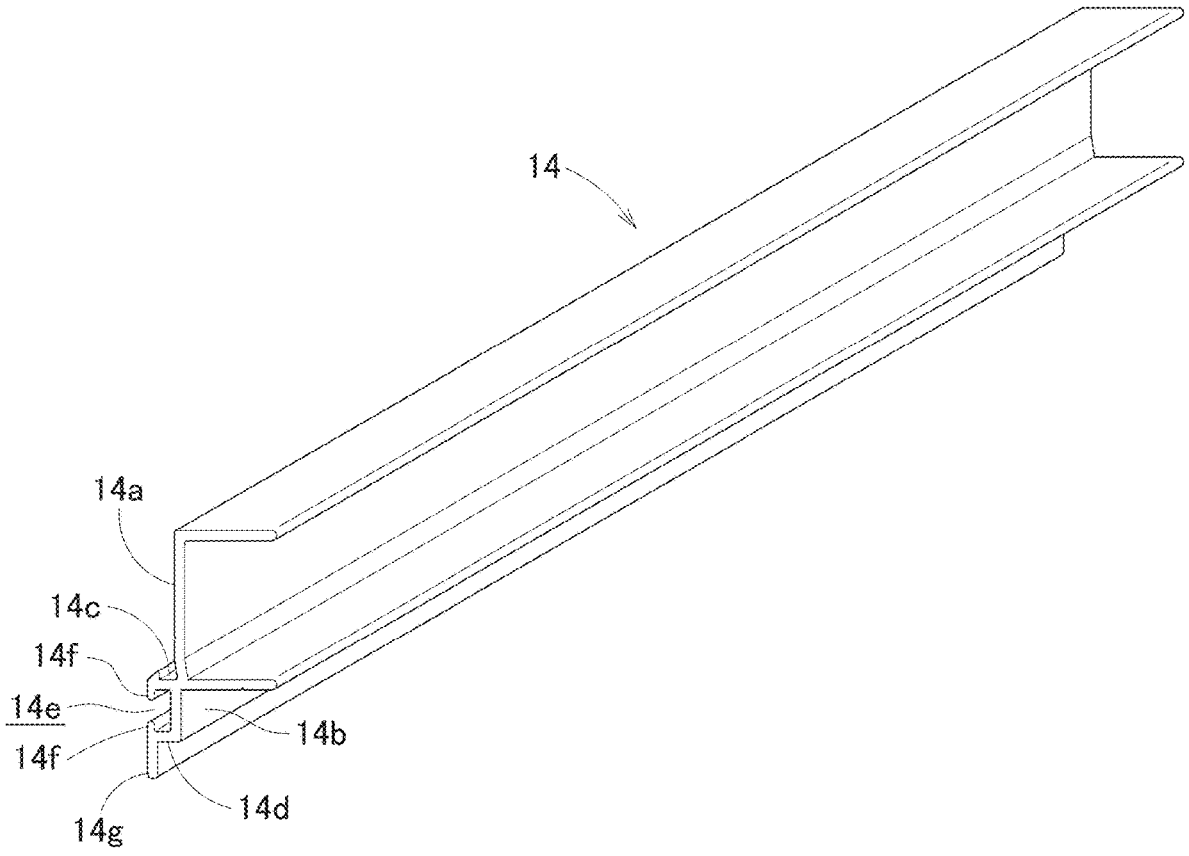
FIG. 32 is a perspective view of a mating frame of the quadrilateral panel and the triangular panel.

Further, the installation ribs 14*g*, 14*g* of the mating frames 14, 14 on the other side surfaces 1*d*, 1*d* of the polygonal panel 1 enter a state of being grounded to the mounting surface 2 (cf. FIG. 27).

By repeating the work as described above, many polygonal panels 1 are mounted one by one on the mounting surface 2, such as the wall surface, and the mounting surface 2 is covered with many polygonal panels 1.

Such mounting work is very easy because a single worker can lift the polygonal panel 1 with both hands and fit the polygonal panel 1 to the furring strip base frame 20. Therefore, the mounting work can be performed by a single worker.

With respect to many polygonal panels 1 mounted on the mounting surface 2, until the second rib 11*f* of the fitting portion 11 reaches the opposite surface portion 20*b* of the furring strip base frame 20 from a state where the second rib 11*f* is separated from the opposite surface portion 20*b*, or until the first rib 11*d* hits the retaining rib 21*b* of the flat portion 21*a*, the fitting portion 11 of the fitting frame 10 can move in the fitting groove 21 of the furring strip base frame 20 and is in the state of being loosely fitted in the fitting groove 21.

Further, since the fitting cap 12 of the polygonal panel 1 is fitted to the fitting receiver 22 that is swingable, the polygonal panel 1 is also swingable in the fitted state.

Figure 6:
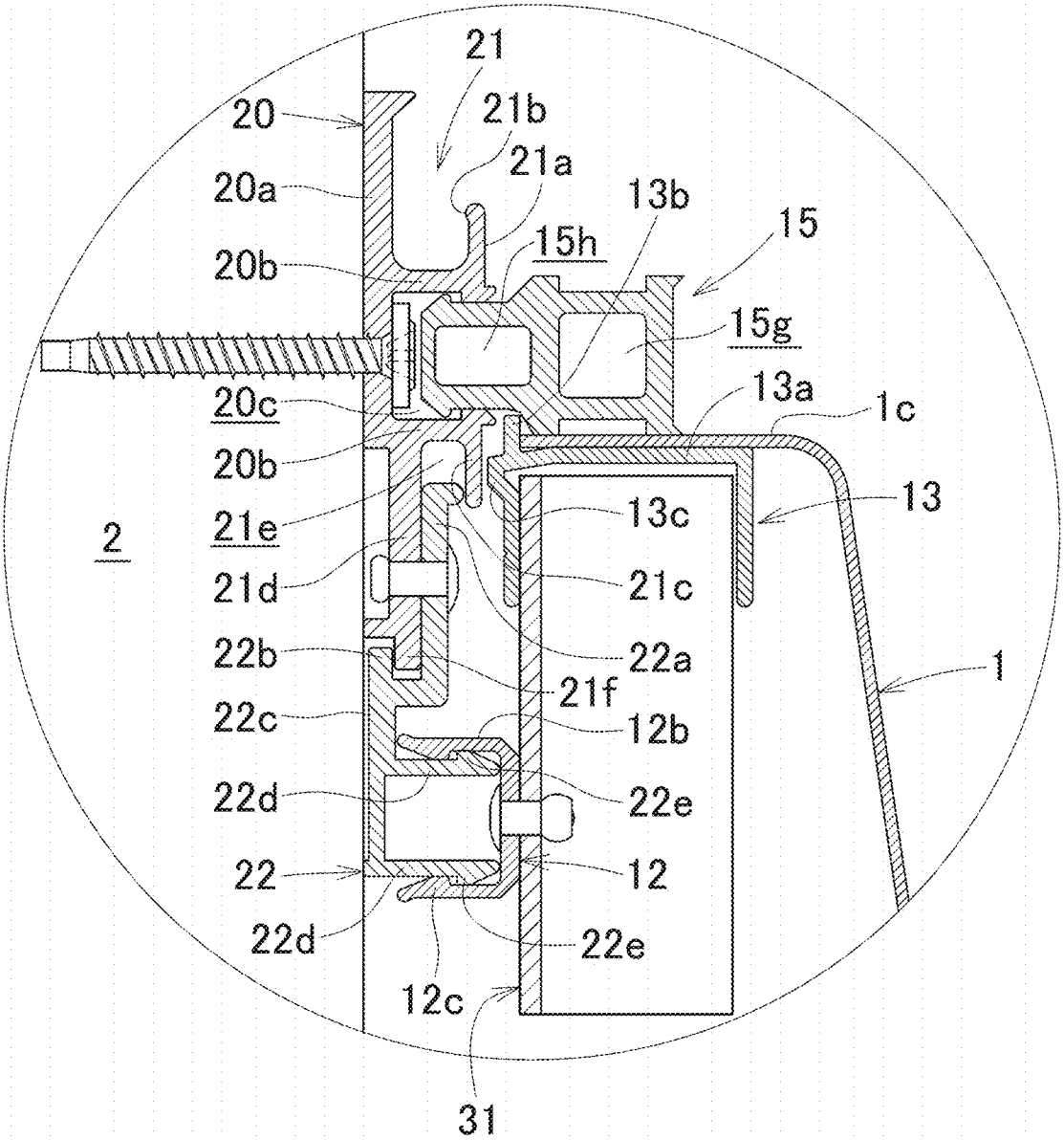
FIG. 6 is an enlarged view of a portion α surrounded by a circle in FIG. 5.

When the planar shape of the polygonal panel 1 is the regular quadrilateral, the gasket 15, which is one member, is pressed between the upper and lower polygonal panels 1 in FIG. 1, and as shown in FIGS. 6, 7, and 12, the retaining ribs 15*d*, 15*e* of the gasket 15 contact the one side portions 1*a*, 1*c* of the upper and lower polygonal panels 1, and the retaining rib 15*f* of the gasket 15 is fitted into the retaining rib 20*d* of the furring strip base frame 20, whereby many polygonal panels 1 are mounted on the mounting surface 2.

Figure 16:
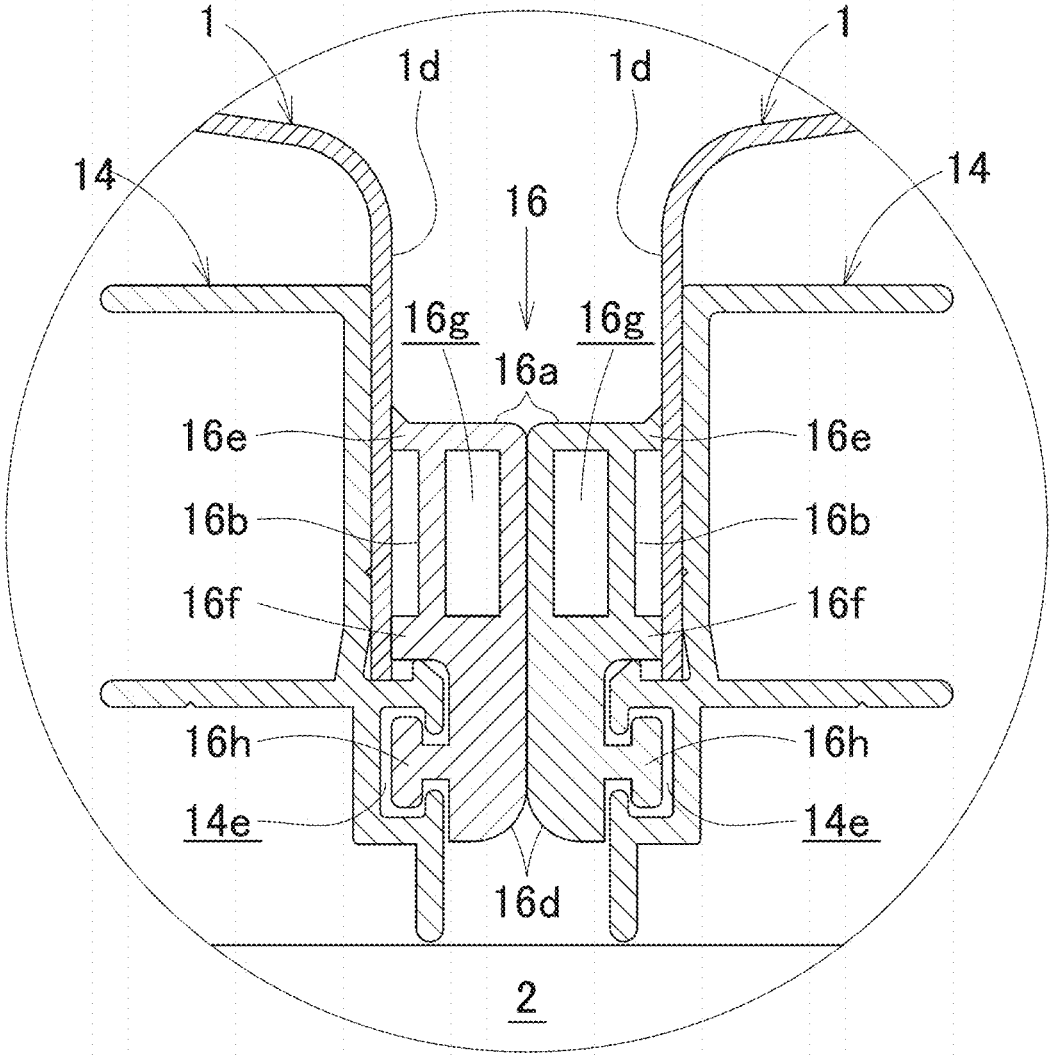
FIG. 16 is an enlarged view of a portion β surrounded by a circle in FIG. 14.

In FIG. 1, the gasket 16 formed of two members is pressed between the left and right polygonal panels 1, with the contact surface portions 16*c* of the two members in contact with each other. More specifically, as shown in FIGS. 10 and 16, the retaining ribs 16*e*, 16*f* of the gasket 16 contact the other side portions 1*d*, 1*d* of the left and right polygonal panels 1, and the retaining rib 16*h* of the gasket 16 is attached in such a way that the retaining rib 16*h* is fitted into the groove portion 14*e* of the mating frame 14. Before the polygonal panel 1 is mounted on the mounting surface 2, the gasket 16 is attached to the polygonal panel 1 by inserting or fitting the retaining rib 16*h* into the groove portion 14*e* of the mating frame 14.

When the planar shape of the polygonal panel 1 is the regular triangle, in FIG. 17, the gasket 15, which is one member, is pressed between the left and right polygonal panels 1. As shown in FIG. 23, the retaining ribs 15*d*, 15*e* of the gasket 15 contact the one side portions 1*a*, 1*a* of the left and right polygonal panels 1, and the retaining rib 15*f* of the gasket 15 is fitted into the retaining rib 20*d* of the furring strip base frame 20, whereby many polygonal panels 1 are mounted to the mounting surface 2.

In FIG. 17, the gasket 16 formed of two members is pressed between the upper and lower polygonal panels 1, with the contact surface portions 16*c* of the two members in contact with each other. Specifically, as shown in FIG. 27, the retaining ribs 16*e*, 16*f* of the gasket 16 contact the other side portions 1*d*, 1*d* of the left and right polygonal panels 1, and the retaining rib 16*h* of the gasket 16 is attached in such a way that the retaining rib 16*h* is fitted into the groove portion 14*e* of the mating frame 14. Before the polygonal panel 1 is mounted on the mounting surface 2, the gasket 16 is attached to the polygonal panel 1 by inserting or fitting the retaining rib 16*h* into the groove portion 14*e* of the mating frame 14.

Further, with respect to the corner of the polygonal panel 1, in FIG. 17, before the polygonal panel 1 is mounted on the mounting surface 2, the fitting groove 17*c* of the gasket 17, which is one member, is fitted and attached to each of the corners of the polygonal panels 1 facing each other across the furring strip base frame 20. When the polygonal panel 1 is mounted on the mounting surface 2, the fitting groove 17*d* of the gasket 17 is fitted and attached to the corner of the polygonal panel 1 adjacent to the polygonal panel 1.

Therefore, in the polygonal panel mounting structure according to the present invention, even when the mounting surface 2, such as the wall surface, is slightly deformed due to an earthquake, a strong wind, or the like, the fitting portion 11 of the fitting frame 10 can move in the fitting groove 21 of the furring strip base frame 20, the fitting cap 12 can swing, and the gaskets 15, 16, 17 are also elastically deformed. Accordingly, the polygonal panel 1 mounted on the mounting surface 2 can adapt to the deformation of the mounting surface 2, and no distortion occurs in each polygonal panel 1 mounted on the mounting surface 2.

REFERENCE SIGNS LIST

1 polygonal panel
1*a* one side portion
1*b* corner
2 mounting surface
10 fitting frame
10*a* attachment surface portion
11 fitting portion
11*a* first flat portion
11*b* second flat portion
11*c* third flat portion
11*d* first rib
11*e* inclined rib
11*f* second rib
12 fitting cap
12*a* attachment surface portion
12*b* opposite surface portion
20 furring strip base frame
20*a* fixed surface portion
20*a* fixed surface portion
20*b* opposite surface portion
21 fitting groove
21*a* flat portion
21*b* retaining rib
21*e* fitting groove
22 fitting receiver
22*a* insertion portion
22*c* fitting surface portion

The invention claimed is:

1. A polygonal panel mounting structure, comprising:

a fitting portion of a fitting frame provided on a one side portion of a polygonal panel configured to be loosely movably fitted into a first fitting groove provided on one of furring strip base frames that are fixed parallel to each other on a mounting surface of the polygonal panel, and a fitting cap provided at a corner facing the one side portion of the polygonal panel is configured to be fitted into a fitting receiver provided on another of the furring strip base frames so as to be swingable, wherein the fitting portion of the fitting frame includes a first flat portion projecting parallel to the mounting surface of the polygonal panel from an attachment surface portion to be attached to the polygonal panel, a second flat portion projecting at a right angle to the mounting surface from the first flat portion, and a third flat portion projecting at a right angle to a side end of the second flat portion, the fitting portion inwardly including, at an outer end of the third flat portion, a first rib that projects parallel to the second flat portion, the fitting portion outwardly including, at the outer end of the third flat portion, an inclined rib angled at 30 to 60 degrees with respect to the third flat portion, and further including, at a base end of the inclined rib, a second rib that projects at a right angle to the second flat portion, and wherein the first fitting groove of the furring strip base frame is surrounded by (i) a fixed surface portion to be fixed to the mounting surface, (ii) a flat portion parallel to the fixed surface portion, and (iii) an opposite surface portion projecting from the fixed surface portion, and a retaining rib engaged with the first rib of the fitting portion is provided at an outer end of the flat portion, the first rib is slidable on the flat portion, the inclined rib of the fitting portion is slidable on the fixed surface portion, and the second rib of the fitting portion is attachable to and detachable from the opposite surface portion.

2. The polygonal panel mounting structure according to claim 1, wherein the fitting cap is provided with opposite surface portions projecting parallel to each other in an elastically deformable manner from both side ends of an attachment surface portion that is attached to a corner of the polygonal panel, and the fitting receiver has an insertion portion to be inserted into a second fitting groove of the furring strip base frame, and the insertion portion is continuously connected to a fitting surface portion designed to be fitted between the opposite surface portions of the fitting cap.

* * * * *